US009891571B2

(12) United States Patent
Sato et al.

(10) Patent No.: US 9,891,571 B2
(45) Date of Patent: Feb. 13, 2018

(54) POST-PROCESSING DEVICE AND IMAGE FORMING APPARATUS

(71) Applicant: FUJI XEROX CO., LTD., Tokyo (JP)

(72) Inventors: Ryuichi Sato, Kanagawa (JP); Misa Hishida, Kanagawa (JP); Jun Noguchi, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/134,611

(22) Filed: Apr. 21, 2016

(65) Prior Publication Data

US 2017/0160690 A1 Jun. 8, 2017

(30) Foreign Application Priority Data

Dec. 3, 2015 (JP) ..... 2015-236560

(51) Int. Cl.
*G03G 15/00* (2006.01)

(52) U.S. Cl.
CPC ..... *G03G 15/6541* (2013.01)

(58) Field of Classification Search
CPC ..... B65H 2801/27; B65H 2801/48; G03G 2215/00822; G03G 2215/00827; G03G 2215/00848; G03G 2215/00831; G03G 15/00; G03G 15/6541
See application file for complete search history.

(56) References Cited

U.S. PATENT DOCUMENTS 6,142,469 A * 11/2000 Nanba ..... B65H 31/10 270/52.03
6,390,466 B1 * 5/2002 Sanmiya ..... B65H 31/14 271/213
2005/0236764 A1 * 10/2005 Saeki ..... B65H 31/24 271/293
2006/0145408 A1 * 7/2006 Kotani ..... B65H 29/36 270/58.08
2008/0122165 A1 * 5/2008 Shirasaki ..... B65H 29/14 271/220

(Continued)

FOREIGN PATENT DOCUMENTS

JP 2001-322762 A 11/2001
JP 2003-89462 A 3/2003

(Continued)

*Primary Examiner* — David Banh
(74) *Attorney, Agent, or Firm* — Sughrue Mion, PLLC

(57) ABSTRACT

A post-processing device includes a processing stacking portion that allows media to be stacked thereon; a binding member that performs a binding process on the media; a medium ejection portion on which the media ejected from the processing stacking portion are stacked and which moves upward and downward; and a pressing member that presses an upper surface of the media on the medium ejection portion. When media that have not been subjected to the binding process are stacked on the medium ejection portion, the pressing member and the media are brought into contact with each other. When media that have been subjected to the binding process are stacked on the medium ejection portion, the pressing member and the media are disposed further away from each other than when media that have not been subjected to the binding process are stacked on the medium ejection portion.

10 Claims, 17 Drawing Sheets

(56) References Cited

U.S. PATENT DOCUMENTS

| | | | | |
|---|---|---|---|---|
| 2010/0150636 | A1* | 6/2010 | Kubota | B42C 1/12 399/407 |
| 2013/0119604 | A1* | 5/2013 | Kubota | B65H 29/26 271/220 |
| 2013/0285305 | A1* | 10/2013 | Gamo | B65H 39/00 270/58.08 |
| 2014/0042695 | A1* | 2/2014 | Maejima | B65H 29/14 271/314 |
| 2014/0238254 | A1* | 8/2014 | Aihara | B41F 16/0026 101/217 |
| 2015/0014916 | A1* | 1/2015 | Saito | B65H 31/3018 271/185 |

FOREIGN PATENT DOCUMENTS

| | | | |
|---|---|---|---|
| JP | 2003-89463 | A | 3/2003 |
| JP | 2006-69746 | A | 3/2006 |
| JP | 2006-69749 | A | 3/2006 |
| JP | 2011-88682 | A | 5/2011 |
| JP | 2012-184114 | A | 9/2012 |

* cited by examiner

POST-PROCESSING DEVICE AND IMAGE FORMING APPARATUS

CROSS-REFERENCE TO RELATED APPLICATIONS

This application is based on and claims priority under 35 USC 119 from Japanese Patent Application No. 2015-236560 filed Dec. 3, 2015.

BACKGROUND

Technical Field

The present invention relates to a post-processing device and an image forming apparatus.

SUMMARY

According to an aspect of the invention, there is provided a post-processing device including a processing stacking portion that allows plural media transported from an upstream side to be stacked thereon; a binding member that performs a binding process on the media stacked on the processing stacking portion; a medium ejection portion on which the media ejected from the processing stacking portion are stacked, the medium ejection portion moving upward and downward in accordance with an amount of the media stacked on the medium ejection portion; and a pressing member that presses an upper surface of the media stacked on the medium ejection portion. When media that have not been subjected to the binding process are stacked on the medium ejection portion, the pressing member and the media on the medium ejection portion are brought into contact with each other, and when media that have been subjected to the binding process are stacked on the medium ejection portion, the pressing member and the media on the medium ejection portion are disposed further away from each other than when media that have not been subjected to the binding process are stacked on the medium ejection portion.

BRIEF DESCRIPTION OF THE DRAWINGS

Exemplary embodiments of the present invention will be described in detail based on the following figures, wherein:

FIG. 11A illustrates a state before the start of ejection of a sheet stack to a stacker tray, FIG. 11B illustrates a state in which the ejection of the sheet stack to the stacker tray is performed after the state of FIG. 11A, and FIG. 11C illustrates a state in which the sheet stack has passed a compile sensor after the state of FIG. 11B;

FIG. 12A illustrates a state before the start of ejection of a sheet stack to the stacker tray, FIG. 12B illustrates a state in which the ejection of the sheet stack to the stacker tray is performed after the state of FIG. 12A, and FIG. 12C illustrates a state in which the sheet stack has passed a compile sensor after the state of FIG. 12B;

DETAILED DESCRIPTION

Exemplary embodiments of the present invention will be described with reference to the drawings. However, the present invention is not limited to the following exemplary embodiments.

To facilitate understanding of the following description, in each figure, the front-back direction, the left-right direction, and the up-down direction are defined as the X-axis direction, the Y-axis direction, and the Z-axis direction, respectively. In addition, the directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "X" marks therein show the direction from front to back with respect to the sides illustrated in the figures.

In each figure, components other than those necessary for explanation are omitted to facilitate understanding.

First Exemplary Embodiment

Overall Structure of Printer U of First Exemplary Embodiment

Figure 1:
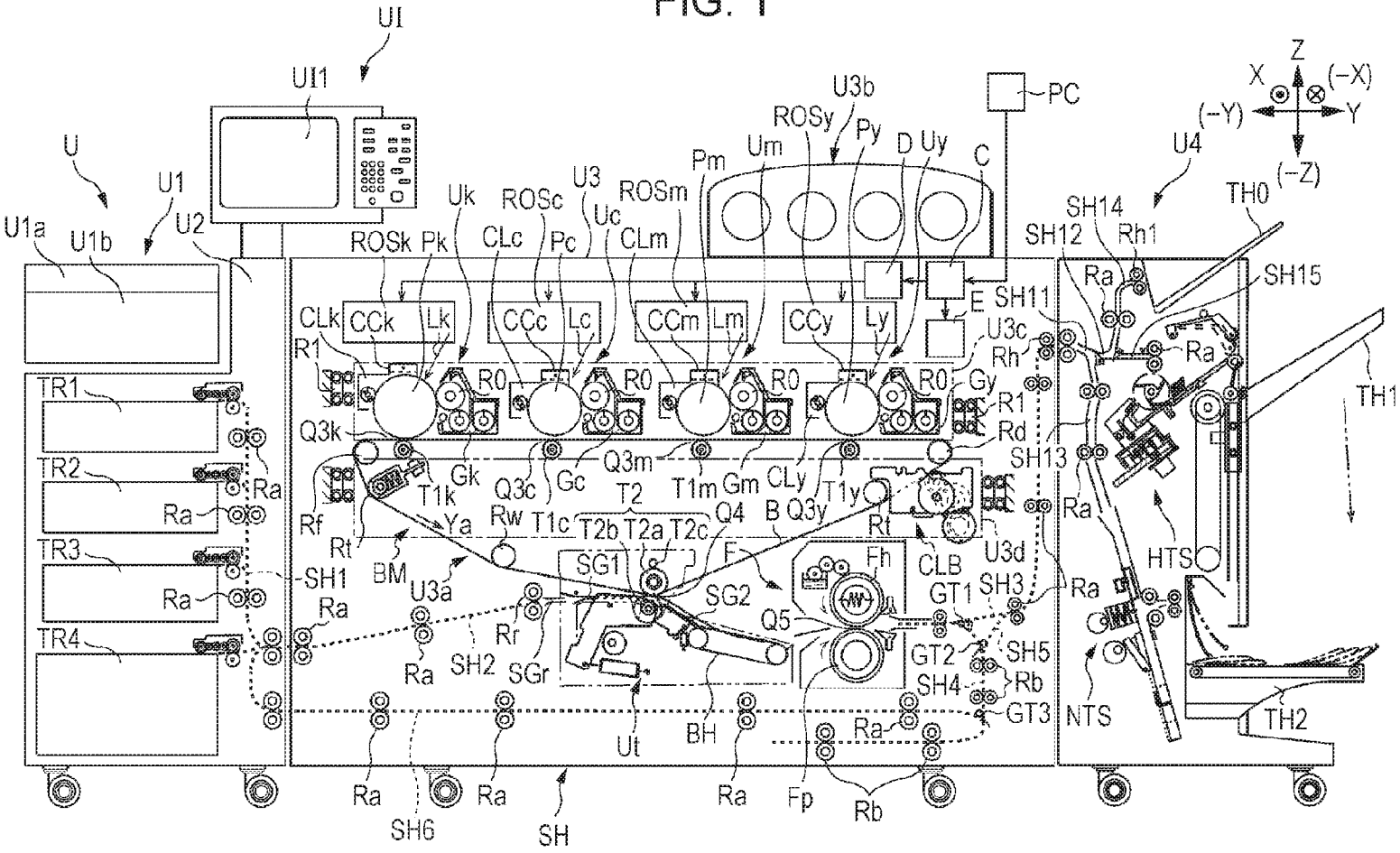
FIG. 1 illustrates the overall structure of an image forming apparatus according to a first exemplary embodiment of the present invention.

FIG. 1 illustrates the overall structure of an image forming apparatus according to a first exemplary embodiment of the present invention.

In FIG. 1, a printer U, which is an example of an image forming apparatus according to the first exemplary embodiment, includes a scanner unit U1 as an example of an image-information reading device. A sheet feeding device U2, which is an example of a medium supplying device, is provided below the scanner unit U1. A printer body U3, which is an example of an image forming apparatus body, is disposed on the right side of the sheet feeding device U2. A finisher U4, which is an example of a post-processing device, is disposed on the right side of the printer body U3. A user interface UI, which is an example of an operation unit, is supported at a location above the sheet feeding device U2.

The user interface UI includes a display panel UI1 as an example of a display, and an input button unit including a copy start key, numeric keys, and a copy-number input key.

The scanner unit U1 includes a document feeder U1*a* as an example of a document transporting device, and an image scanner U1*b* as an example of an image reading unit.

The sheet feeding device U2 includes plural sheet feeding trays TR1 to TR4 as examples of medium containers. Each of the sheet feeding trays TR1 to TR4 contains sheets S as examples of media. A supply path SH1, which is an example of a transport path, is provided in the sheet feeding device U2. The supply path SH1 connects the sheet feeding trays TR1 to TR4 to the printer body U3.

Structure of Image Recording Unit U3*a* of First Exemplary Embodiment

In FIG. 1, the printer body U3 includes an image recording unit U3*a* that records an image on a sheet S. A toner dispenser U3*b*, which is an example of a developer supplying device, is disposed above the image recording unit U3*a*.

The printer body U3 includes a controller C as an example of a control section. The controller C is electrically connected to a client personal computer PC, which is an example of an image information transmitter. The controller C receives image information or the like transmitted from the client personal computer PC. The controller C controls a laser driving circuit D, which is an example of an exposure-device driving circuit, and a power supply circuit E.

The laser driving circuit D outputs signals of image information for respective colors, which are yellow (Y), magenta (M), cyan (C), and black (K), to exposure devices ROSy, ROSm, ROSc, and ROSk for the respective colors Y, M, C, and K on the basis of the information input from the scanner unit U1 or the client personal computer PC at a preset timing.

A drawer member U3*c* of an image forming unit is supported below the exposure devices ROSy, ROSm, ROSc, and ROSk for the respective colors Y, M, C, and K. The drawer member U3*c* of the image forming unit is supported by a pair of left and right guiding members R1 and R1 such that the drawer member U3*c* is moveable between a position in front of the printer body U3 to which the drawer member U3*c* is drawn and a position at which the drawer member U3*c* is installed in the printer body U3.

Figure 2:
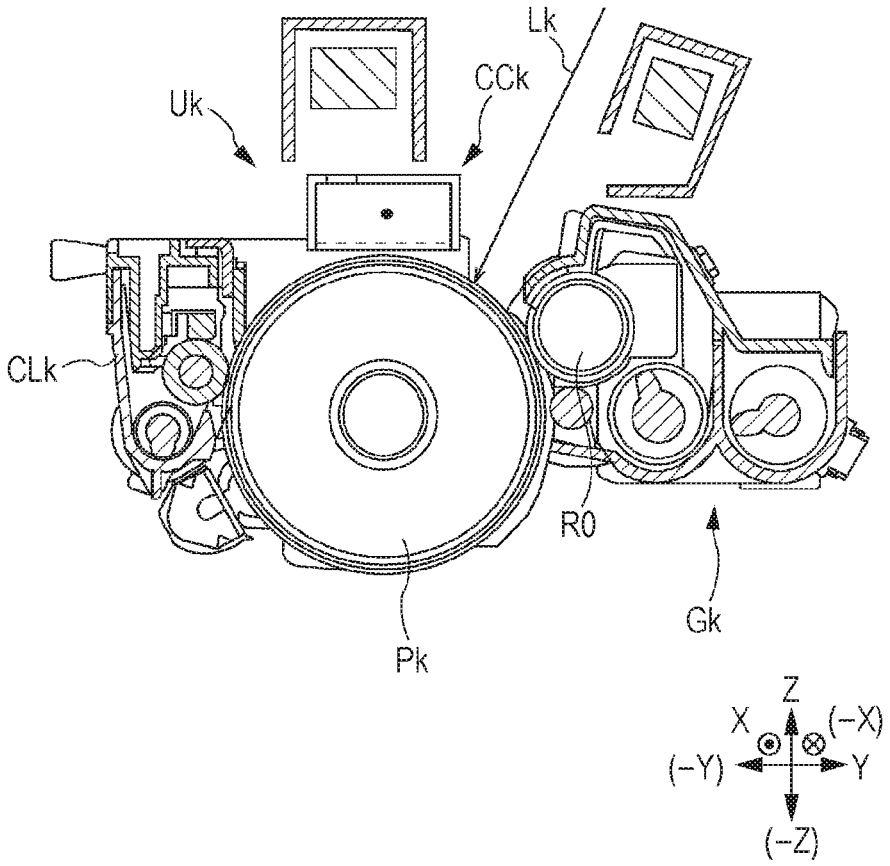
FIG. 2 illustrates a visual-image forming member including an image carrier unit and a developing device according to the first exemplary embodiment of the present invention.

FIG. 2 illustrates a visual-image forming member including an image carrier unit and a developing device according to the first exemplary embodiment of the present invention.

Referring to FIGS. 1 and 2, photoconductors Py, Pm, Pc, and Pk, which are examples of image carriers, are disposed below the respective exposure devices ROSy, ROSm, ROSc, and ROSk. In the first exemplary embodiment, the black (K) photoconductor Pk, which is frequently used and whose surface easily wears, has a diameter greater than those of the photoconductors Py, Pm, and Pc for the other colors Y, M, and C. Accordingly, the black (K) photoconductor Pk is rotatable at a high speed, and has a long lifespan.

A charger CCk, which is an example of a charging device, is disposed above the black (K) photoconductor Pk. A developing device Gk is disposed downstream of the charger CCk in a rotational direction in which the photoconductor Pk rotates. The developing device Gk includes a developing roller R0 as an example of a developer carrier. A first transfer roller T1*k*, which is an example of a first transfer device, is disposed downstream of the developing device Gk in the rotational direction of the photoconductor Pk. A cleaner CLk, which is an example of a photoconductor cleaning device, is disposed downstream of the first transfer roller T1*k* in the rotational direction of the photoconductor Pk.

The photoconductor Pk, the charger CCk, and the cleaner CLk form a black (K) photoconductor unit Uk as an example of an image carrier unit according to the first exemplary embodiment. Therefore, the photoconductor Pk, the charger CCk, and the cleaner CLk are formed integrally with each other and are detachably attached to the printer body U3. Similarly to the black (K) photoconductor unit Uk, photoconductor units Uy, Um, and Uc for the other colors are formed of photoconductors Py, Pm, and Pc, chargers CCy, CCm, and CCc, and cleaners CLy, CLm, and CLc.

The photoconductor units Uy, Um, Uc, and Uk and the developing devices Gy, Gm, Gc, and Gk constitute visible-image forming members Uy+Gy, Um+Gm, Uc+Gc, and Uk+Gk according to the first exemplary embodiment. The photoconductor units Uy, Um, Uc, and Uk and the developing devices Gy, Gm, Gc, and Gk are detachably attached to the above-described drawer member U3*c* of the image forming unit.

A drawer member U3*d* of an intermediate transfer body is supported below the drawer member U3*c* of the image forming unit. The drawer member U3*d* of the intermediate transfer body is supported such that the drawer member U3*d* is moveable between a position in front of the printer body U3 to which the drawer member U3*d* is drawn and a position at which the drawer member U3*d* is installed in the printer body U3. A belt module BM, which is an example of an intermediate transfer device, is supported by the drawer member U3*d* of the intermediate transfer body. The belt module BM is supported such that the belt module BM is movable upward and downward between a position at which the belt module BM is in contact with the bottom surfaces of the photoconductors Py, Pm, Pc, and Pk and a position at which the belt module BM is below the bottom surfaces of the photoconductors Py, Pm, Pc, and Pk.

The belt module BM includes an intermediate transfer belt B, belt support rollers Rd, Rt, Rw, Rf, and T2*a*, which are examples of intermediate-transfer-body support members, and first transfer rollers T1*y*, T1*m*, T1*c*, and T1*k*. The belt support rollers Rd, Rt, Rw, Rf, and T2*a* include a belt driving roller Rd, which is an example of an intermediate-transfer-body driving member; a tension roller Rt, which is an example of a tension applying member; a walking roller Rw, which is an example of a meandering preventing member; plural idler rollers Rf, which are examples of driven members; and a backup roller T2*a*, which is an example of an opposing member for a second transfer process. The intermediate transfer belt B is supported by the belt support rollers Rd, Rt, Rw, Rf, and T2*a* such that the intermediate transfer belt B is rotatable in the direction of arrow Ya.

A belt cleaner CLB, which is an example of an intermediate-transfer-body cleaning device, is disposed near the belt driving roller Rd.

A second transfer unit Ut is disposed below the backup roller T2*a*. The second transfer unit Ut includes a second transfer roller T2*b* as an example of a second transfer member. The region in which the second transfer roller T2*b* is in contact with the intermediate transfer belt B serves as a second transfer region Q4, which is an example of an image recording region. A contact roller T2*c*, which is an example of a voltage-applying contact member, is in contact with the backup roller T2*a*. A second transfer voltage having the same polarity as the charging polarity of the toner is applied to the contact roller T2*c* by the power supply circuit E, controlled by the controller C, at a preset timing.

The backup roller T2*a*, the second transfer roller T2*b*, and the contact roller T2*c* form a second transfer device T2 according to the first exemplary embodiment. The first transfer rollers T1*y*, T1*m*, T1*c*, and T1*k*, the intermediate transfer belt B, and the second transfer device T2 constitute a transferring device T1+B+T2 according to the first exemplary embodiment which transfers the images on the surfaces of the photoconductors Py to Pk onto the sheet S.

A feeding path SH2, which is an example of a transport path, is disposed below the belt module BM. The feeding path SH2 extends from the supply path SH1 of the sheet feeding device U2 toward the second transfer region Q4. Plural transport rollers Ra, which are examples of medium transporting members, are arranged along the feeding path SH2. In addition, a registration roller Rr is provided on the feeding path SH2 at a location upstream of the second transfer region Q4 in the transporting direction of the sheet S. The registration roller Rr is an example of an adjusting member that adjust a transport timing at which the sheet S is transported to the second transfer device T2. A guiding member SGr for guiding the medium is disposed downstream of the registration roller Rr in the transporting direction of the sheet S. The guiding member SGr for the medium is fixed to the printer body U3 together with the registration roller Rr. A guiding member SG1 for guiding the medium before the transfer process is disposed between the guiding member SGr for the medium and the second transfer region Q4.

A guiding member SG2 for guiding the medium after the transfer process is disposed downstream of the second transfer region Q4 in the transporting direction of the sheet S. A transporting belt BH, which is an example of a medium transporting member, is disposed downstream of the guiding member SG2 for guiding the medium after the transfer process in the transporting direction of the sheet S. A fixing device F is disposed downstream of the transporting belt BH in the transporting direction of the sheet S. The fixing device F includes a heating roller Fh, which is an example of a heating fixing member, and a pressing roller Fp, which is an example of a pressing fixing member. The region in which the heating roller Fh and the pressing roller Fp are in contact with each other serves as a fixing region Q5.

The visible-image forming members Uy+Gy to Uk+Gk, the transferring device T1+B+T2, and the fixing device F constitute the image recording unit U3*a* according to the first exemplary embodiment.

An ejection path SH3, which is an example of a transport path, is disposed downstream of the fixing device F in the transporting direction of the sheet S. The ejection path SH3 extends rightward and upward from the downstream end of the feeding path SH2 in the transporting direction of the sheet S. The transport rollers Ra are arranged along the ejection path SH3. An ejection roller Rh, which is an example of a medium ejecting member, is disposed at the downstream end of the ejection path SH3 in the transporting direction of the sheet S.

An upstream end of a reversing path SH4, which is an example of a transport path, in the transporting direction of the sheet S is connected to a connecting portion between the feeding path SH2 and the ejection path SH3. The reversing path SH4 extends downward. Reversing rollers Rb, which are examples of medium reversing members and which are rotatable in forward and reverse directions, are arranged along the reversing path SH4. An upstream end of an ejecting-reversing path SH5, which is an example of a transport path, in the transporting direction of the sheet S is connected to the reversing path SH4 at an intermediate position thereof. The downstream end of the ejecting-reversing path SH5 in the transporting direction of the sheet S is connected to the ejection path SH3. An upstream end of a circulation path SH6, which is an example of a transport path, in the transporting direction of the sheet S is connected to the reversing path SH4 at an intermediate position thereof that is downstream of the position at which the reversing path SH4 is connected to the ejecting-reversing path SH5 in the transporting direction of the sheet S. The circulation path SH6 connects the reversing path SH4 to the supply path SH1 of the sheet feeding device U2. Transport rollers Ra are arranged along the circulation path SH6.

A switching gate GT1, which is an example of a destination switching member, is provided on a connecting portion between the feeding path SH2 and the ejection path SH3.

A Mylar gate GT2, which is an example of a transporting-direction regulating member, is provided on a connecting portion between the reversing path SH4 and the ejecting-reversing path SH5.

A Mylar gate GT3, which is also an example of a transporting-direction regulating member, is provided on a connecting portion between the reversing path SH4 and the circulation path SH6.

Elements denoted by SH1 to SH6 constitute a transporting path body SH according to the first exemplary embodiment.

Operation of Image Recording Unit U3*a* of First Exemplary Embodiment

When the controller C receives image information from the client personal computer PC or the scanner unit U1, the printer U starts a job, that is, an image forming operation. When the job is started, the photoconductors Py to Pk, the intermediate transfer belt B, and other components start to rotate.

The chargers CCy to CCk receive a preset voltage from the power supply circuit E, and charge the surfaces of the photoconductors Py to Pk.

The exposure devices ROSy to ROSk output laser beams Ly, Lm, Lc, and Lk, which are examples of latent-image-writing light, on the basis of signals from the laser driving circuit D. The surfaces of the photoconductors Py to Pk are irradiated with the laser beams Ly to Lk so that electrostatic latent images are formed thereon.

The developing rollers R0 of the developing devices Gy to Gk develop the electrostatic latent images on the surfaces of the photoconductors Py to Pk into visible images.

The toner dispenser U3*b* supplies developers to the developing devices Gy to Gk when the developers in the developing devices Gy to Gk are consumed.

The power supply circuit E applies a first transfer voltage to the first transfer rollers T1*y* to T1*k*, the first transfer voltage having a polarity opposite to the charging polarity of the developers. Thus, the visible images on the surfaces of the photoconductors Py to Pk are transferred onto the surface of the intermediate transfer belt B.

The cleaners CLy to CLk clean the surfaces of the photoconductors Py to Pk by removing the developers that remain thereon after the first transfer process.

Y, M, C, and K images are transferred onto the intermediate transfer belt B in that order in a superimposed manner when the intermediate transfer belt B passes through the first transfer regions Q3*y* to Q3*k* that face the photoconductors Py to Pk, respectively. Then, the intermediate transfer belt B passes through the second transfer region Q4 that faces the second transfer device T2. When a monochrome image is to be formed, a single colored image is transferred onto the intermediate transfer belt B, and then the intermediate transfer belt B passes through the second transfer region Q4.

The sheet feeding trays TR1 to TR4 contain sheets S. A sheet S contained in one of the sheet feeding trays TR1 to TR4 is transported along the supply path SH1 of the sheet feeding device U2 by the transport rollers Ra, and fed to the feeding path SH2 of the printer body U3.

The sheet S fed to the feeding path SH2 is transported toward the registration roller Rr.

The registration roller Rr feeds the sheet S toward the second transfer region Q4 at the time when the image on the surface of the intermediate transfer belt B is transported to the second transfer region Q4.

In the second transfer device T2, the power supply circuit E applies a second transfer voltage to the backup roller T2*a* through the contact roller T2*c*. The second transfer voltage has the same polarity as the preset charging polarity of the developers. Therefore, the image on the intermediate transfer belt B is transferred onto the sheet S that passes through the second transfer region Q4.

The belt cleaner CLB cleans the surface of the intermediate transfer belt B by removing the developers that remain thereon after the image has been transferred in the second transfer region Q4.

The transporting belt BH holds the sheet S, onto which the image has been transferred by the second transfer device T2, on the surface thereof and transports the sheet S to the fixing device F.

The fixing device F heats the sheet S that passes through the fixing region Q5 while applying a pressure to the sheet S. Accordingly, the unfixed image on the surface of the sheet S is fixed to the sheet S. The sheet S to which the image has been fixed is transported to the downstream end of the feeding path SH2 in the transporting direction of the sheet S.

The switching gate GT1 at the downstream end of the feeding path SH2 in the transporting direction of the sheet S switches the destination of the sheet S between the ejection path SH3 and the reversing path SH4.

When the sheet S is to be ejected in a reversed manner or when double-sided printing is to be performed, the destination of the sheet S having an image recorded on one side thereof is switched to the reversing path SH4. Accordingly, the sheet S is transported to the reversing path SH4. The sheet S is transported along the reversing path SH4 by the reversing rollers Rb and passes through the Mylar gate GT2.

When the sheet S is to be ejected in a reversed state, the reversing rollers Rb start to rotate in the reverse direction after the upstream end of the sheet S in the transporting direction of the sheet S has passed the Mylar gate GT2. Accordingly, the sheet S is transported in the reverse direction in a so-called switchback manner. When double-sided printing is to be performed, the reversing rollers Rb start to rotate in the reverse direction after the upstream end of the sheet S in the transporting direction of the sheet S has passed the Mylar gate GT2 and the Mylar gate GT3, so that the sheet S is transported in the switchback manner.

The Mylar gate GT2 allows the sheet S that has been transported along the reversing path SH4 to pass therethrough. Then, the Mylar gate GT2 regulates the transporting direction of the sheet S transported in a switchback manner so as to guide the sheet S to the ejecting-reversing path SH5. Accordingly, the sheet S is guided from the ejecting-reversing path SH5 to the ejection path SH3.

The Mylar gate GT3 allows the sheet S that has been transported along the reversing path SH4 to pass therethrough. Then, the Mylar gate GT3 regulates the transporting direction of the sheet S transported in a switchback manner to guide the sheet S to the circulation path SH6.

The sheet S that has been transported to the circulation path SH6 is transported to the supply path SH1 in the sheet feeding device U2. Thus, the sheet S transported in the switchback manner is transported from the supply path SH1 to the registration roller Rr on the feeding path SH2 again in a reversed state. Accordingly, an image is recorded on a second side of the sheet S.

When the sheet S on which an image is recorded is ejected from the printer body U3, the destination of the sheet S is switched to the ejection path SH3. Accordingly, the sheet S having the image recorded thereon is guided to the ejection path SH3. The sheet S is transported along the ejection path SH3 by the transport rollers Ra, and ejected from the printer body U3 by the ejection roller Rh.

Structure of Finisher U4 of First Exemplary Embodiment

Figure 3:
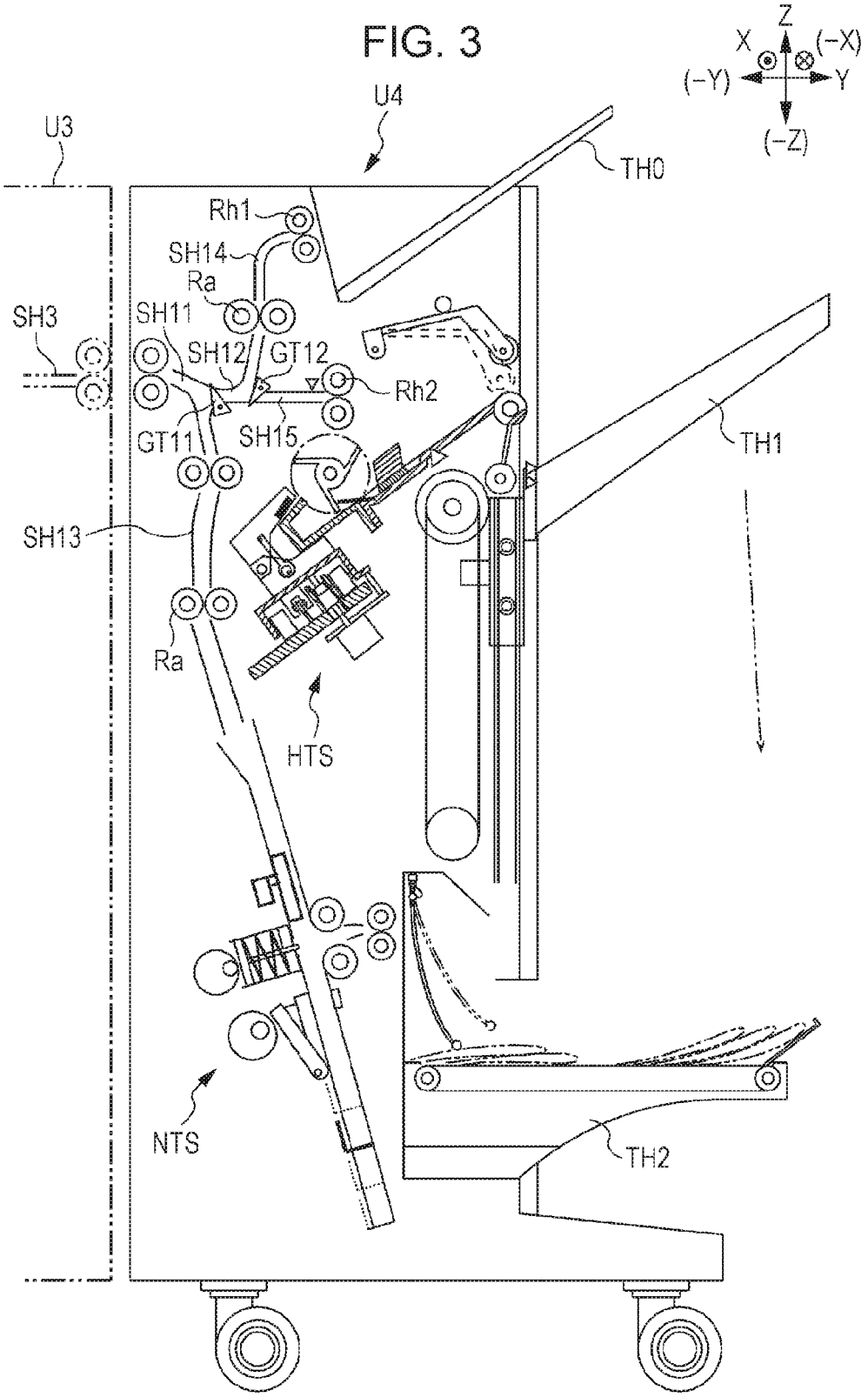
FIG. 3 illustrates a post-processing device according to the first exemplary embodiment of the present invention.

FIG. 3 illustrates a post-processing device according to the first exemplary embodiment of the present invention.

In FIGS. 1 and 3, the finisher U4, which is an example of a post-processing device, is disposed on the right side of the printer body U3. The finisher U4 includes a feeding path SH11, which is an example of a transport path. The feeding path SH11 extends into the finisher U4 from the downstream end of the ejection path SH3 of the printer body U3 in the transporting direction of the sheet S. An upstream end of a relay path SH12, which is an example of a transport path and which extends rightward, in the transporting direction of the sheet S is connected to the downstream end of the feeding path SH11 in the transporting direction of the sheet S. An upstream end of a saddle-stitching transport path SH13, which is an example of a transport path and which extends downward, in the transporting direction of the sheet S is also connected to the downstream end of the feeding path SH11 in the transporting direction of the sheet S.

An upstream end of an ejection path SH14, which is an example of a transport path and which extends upward, in the transporting direction of the sheet S is connected to the downstream end of the relay path SH12 in the transporting direction of the sheet S. An upstream end of an edge-binding transport path SH15, which is an example of a transport path and which extends rightward, in the transporting direction of the sheet S is connected to the downstream end of the relay path SH12 in the transporting direction of the sheet S.

A first gate GT11, which is an example of a destination switching member, is provided at a branching portion between the relay path SH12 and the saddle-stitching transport path SH13.

A second gate GT12, which is also an example of a destination switching member, is provided at a branching portion between the ejection path SH14 and the edge-binding transport path SH15.

An ejection roller Rh1, which is an example of an ejecting member, is arranged at the downstream end of the ejection path SH14 in the transporting direction of the sheet S. A top tray TH0, which is an example of a medium receiver, is supported at a location downstream of the ejection roller Rh1 in an ejecting direction in which the sheet S is ejected.

An edge binding device HTS is disposed downstream of the edge-binding transport path SH15 in the transporting direction of the sheet S. The edge binding device HTS may have a well-known structure as those described in, for example, Japanese Unexamined Patent Application Publication Nos. 2003-089462, 2003-089463, 2006-69746, or 2006-69749, and detailed description of the edge binding device HTS is thus omitted. A stacker tray TH1, which is an example of an edge-binding receiver, is supported at a location downstream of the edge binding device HTS in the transporting direction of the sheet S. The stacker tray TH1 is supported in a vertically movable manner.

A saddle stitching device NTS is disposed downstream of the saddle-stitching transport path SH13 in the transporting direction of the sheet S. A saddle-stitching stacker tray TH2, which is an example of a saddle-stitching receiver, is supported at a location downstream of the saddle stitching device NTS in the transporting direction of the sheet S.

Operation of Finisher U4 of First Exemplary Embodiment

The sheet S transported from the printer body U3 is fed to the feeding path SH11 of the finisher U4. The sheet S fed to the feeding path SH11 is transported to the first gate GT11.

The first gate GT11 switches the destination of the sheet S between the relay path SH12 and the saddle-stitching transport path SH13 depending on the settings regarding post-processing.

The sheet S fed to the relay path SH12 is transported to the second gate GT12.

The second gate GT12 switches the destination of the sheet S between the ejection path SH14 and the edge-binding transport path SH15 depending on the settings regarding post-processing.

The sheet S fed to the ejection path SH14 is ejected to the top tray TH0 by the ejection roller Rh1.

The sheet S fed to the edge-binding transport path SH15 is transported to the edge binding device HTS.

The edge binding device HTS aligns the edges of plural sheets S and binds the edges of the sheets S together. The stack of sheets S processed by the edge binding device HTS is ejected to the stacker tray TH1.

When the stack of sheets S is placed on the stacker tray TH1, the stacker tray TH1 moves downward depending on the number of sheets S placed thereon.

The sheet S fed to the saddle-stitching transport path SH13 is transported to the saddle stitching device NTS.

The saddle stitching device NTS processes a stack of sheets S so as to bind the sheets S together at the center thereof in the transporting direction of the sheets S. The saddle stitching device NTS folds the stack of bound sheets S in half at the center and ejects the folded stack of sheets S to the saddle-stitching stacker tray TH2.

Details of Edge-Binding Transport Path of First Exemplary Embodiment

Figure 4:
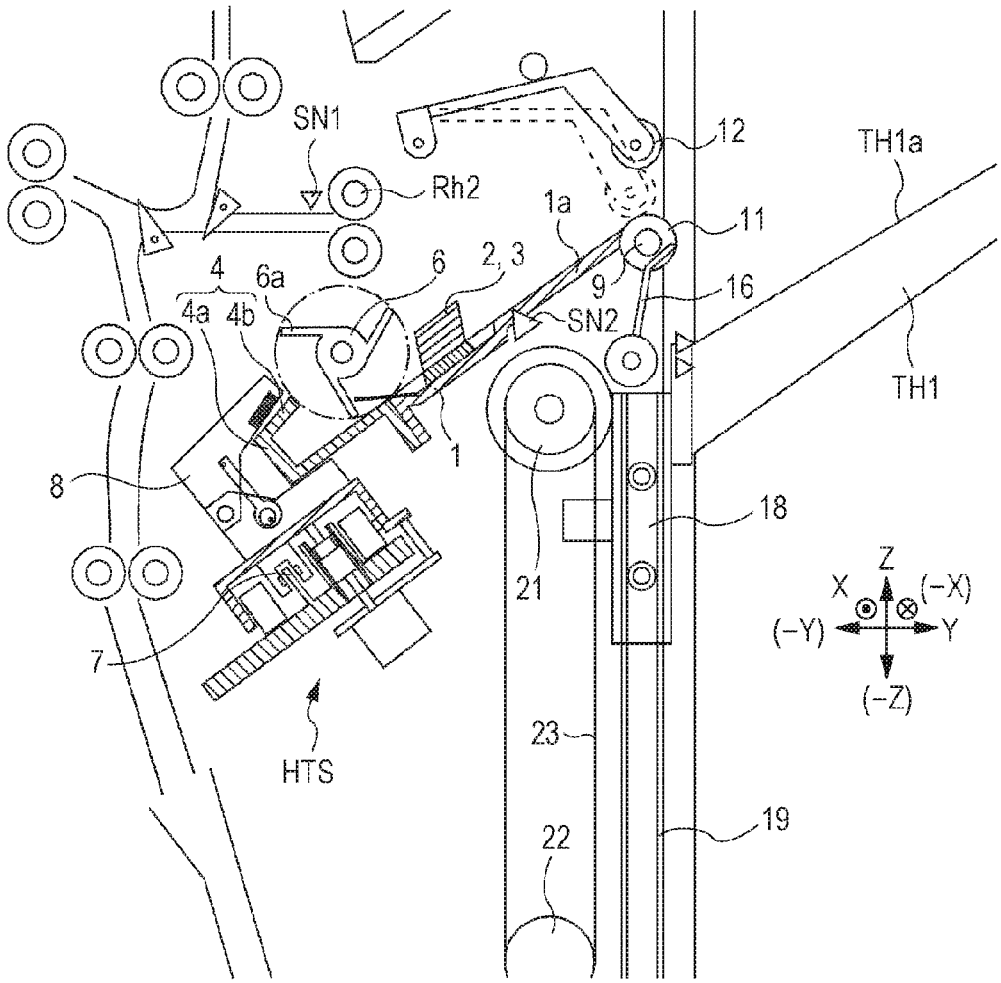
FIG. 4 illustrates how a clamping roller moves in an edge binding device according to the first exemplary embodiment of the present invention.

FIG. 4 illustrates how a clamping roller 12 moves in the edge binding device HTS according to the first exemplary embodiment of the present invention.

Figure 5:
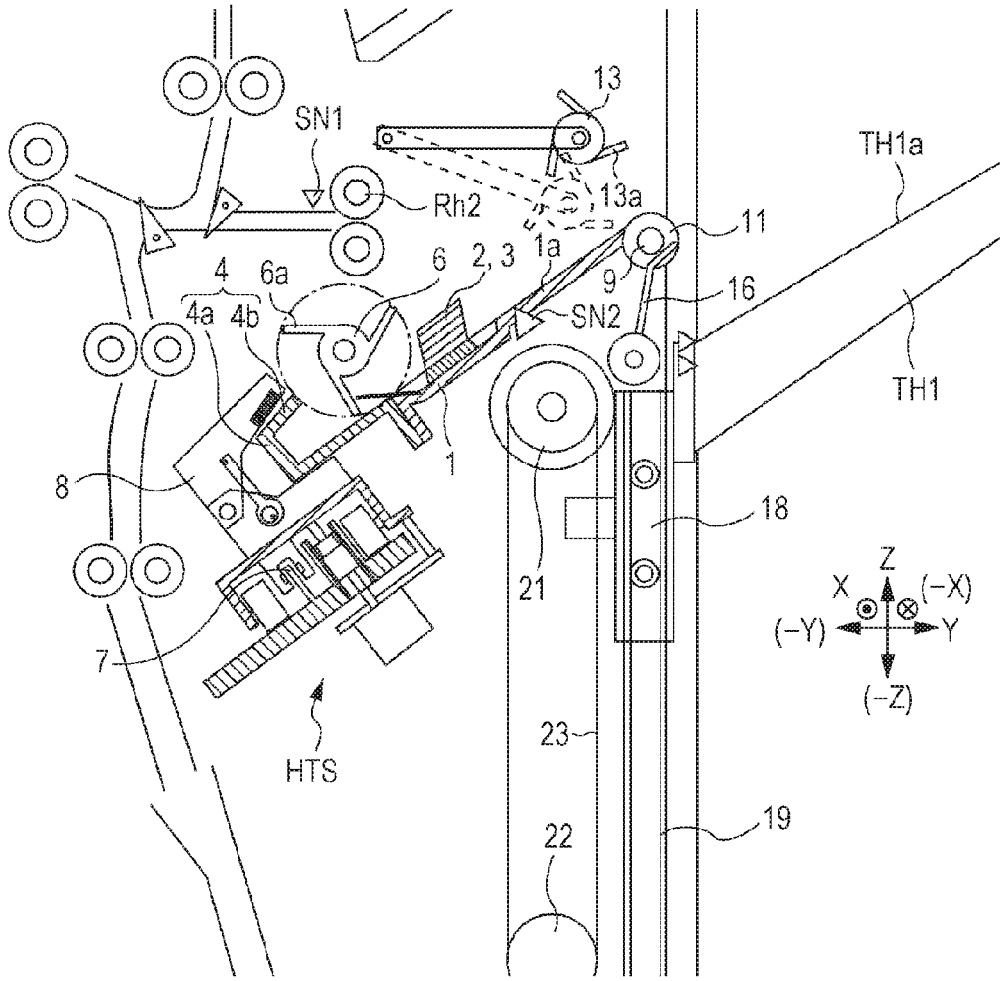
FIG. 5 illustrates how a second paddle wheel moves in the edge binding device according to the first exemplary embodiment of the present invention.

FIG. 5 illustrates how a second paddle wheel 13 moves in the edge binding device HTS according to the first exemplary embodiment of the present invention.

Referring to FIGS. 4 and 5, an exit roller Rh2, which is an example of an ejecting member and is also an example of a feeding member, is disposed at the downstream end of the edge-binding transport path SH15 in the transporting direction of the sheets S. An exit sensor SN1, which is an example of a medium detecting member, is disposed upstream of the exit roller Rh2 in the transporting direction of the sheets S.

Details of Edge Binding Device of First Exemplary Embodiment

Referring to FIGS. 4 and 5, the edge binding device HTS is disposed downstream of the exit roller Rh2 in the transporting direction of the sheets S.

The edge binding device HTS includes a compiler tray 1 as an example of a processing stacking portion. The compiler tray 1 has a stacking surface 1*a* on which the sheets S are stacked. The stacking surface 1*a* is slightly inclined with respect to the horizontal direction so as to extend rightward and upward.

A pair of tampers 2 and 3, which are examples of aligning members for aligning the edges of media in the width direction, are provided on the compiler tray 1. The tampers 2 and 3 are arranged in the front-back direction, and are supported so as to be movable in the front-back direction. Accordingly, the tampers 2 and 3 are movable toward and away from each other.

An end wall 4, which is an example of an aligning member for aligning the edges of the media in the transporting direction thereof, is supported on a lower left portion of the compiler tray 1. The end wall 4 includes a positioning wall 4*a* that stands on the stacking surface 1*a* of the compiler tray 1, and a guide wall 4*b* that extends upward and rightward from the top edge of the positioning wall 4*a*.

A first paddle wheel 6, which is an example of a first drawing member, is supported above the end wall 4. The first paddle wheel 6 is rotatably supported. The first paddle wheel 6 includes flexible sheet contact portions 6*a* that extend radially outward. The sheet contact portions 6*a* are capable of coming into contact with the sheets S on the compiler tray 1. The first paddle wheel 6 receives a driving force from a driving source (not shown).

A stapler guide 7, which is an example of a binding-member guide, is supported in a region below and on the left side of the end wall 4. The stapler guide 7 extends parallel to the end wall 4 in the front-back direction.

A stapler 8, which is an example of a binding member, is supported by the stapler guide 7. The stapler 8 is moveable along the stapler guide 7. Thus, the stapler 8 is supported so as to be moveable parallel to the end wall 4 in the front-back direction.

An ejection shaft 9, which extends in the front-back direction, is provided at the upper right end of the compiler tray 1. The ejection shaft 9 is rotatably supported. The ejection shaft 9 supports an ejecting roller 11, which is an example of a second ejecting member. The ejection shaft 9 is capable of receiving forward and reverse driving force from a driving source (not shown). Thus, the ejecting roller 11 is capable of rotating in forward and reverse directions. A compile sensor SN2, which detects sheets S on the compiler tray 1, is disposed upstream of the ejecting roller 11 in the ejecting direction.

Referring to FIG. 4, the clamping roller 12, which is an example of a medium clamping member, is disposed above the ejecting roller 11. The clamping roller 12 is moveable upward and downward between an upper position shown by the solid lines in FIG. 4, at which the clamping roller 12 is separated from the ejecting roller 11, and a lower position shown by the dashed lines in FIG. 4, at which the clamping roller 12 is near the ejecting roller 11 and is in contact with the sheets S.

Referring to FIG. 5, the second paddle wheel 13, which is an example of a second drawing member, is disposed above the compiler tray 1 at a position shifted from the clamping roller 12 in the front-back direction. The second paddle wheel 13 is rotatably supported. The second paddle wheel 13 includes flexible sheet contact portions 13*a* that extend radially outward. The second paddle wheel 13 receives a driving force from a driving source (not shown) through, for example, a pulley and a belt (not shown), which are examples of driving-force transmission members.

The second paddle wheel 13 is moveable upward and downward between an upper position shown by the solid lines in FIG. 5, at which the second paddle wheel 13 is separated from the compiler tray 1, and a lower position shown by the dashed lines in FIG. 5, at which the second paddle wheel 13 is in contact with the sheets S on the compiler tray 1.

The tampers 2 and 3, the first paddle wheel 6, the stapler 8, the clamping roller 12, and the second paddle wheel 13 of the edge binding device HTS may have structures as those described in, for example, Japanese Unexamined Patent Application Publication Nos. 2003-89463, 2006-69746, and 2009-240970, and detailed description thereof is thus omitted.

Figure 6:
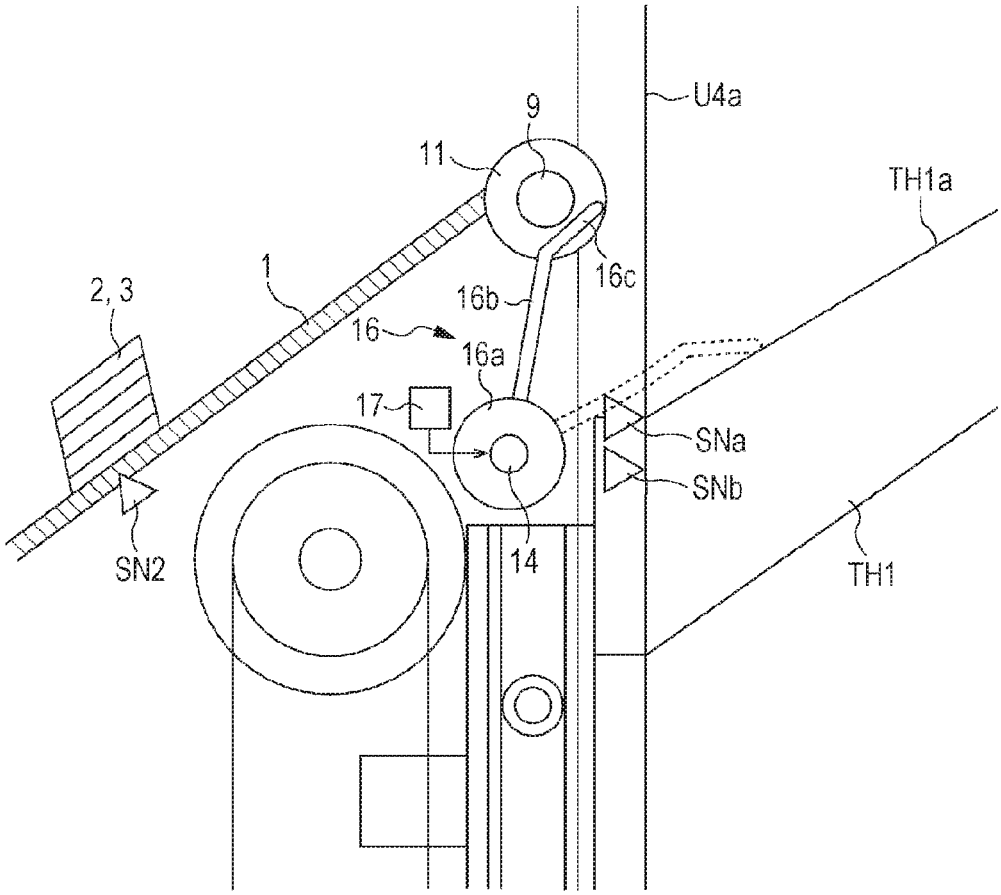
FIG. 6 illustrates a clamping member according to the first exemplary embodiment of the present invention.

FIG. 6 illustrates a clamping member 16 according to the first exemplary embodiment of the present invention.

Referring to FIG. 6, a rotating shaft 14, which extends in the front-back direction, is disposed below the ejecting roller 11. The rotating shaft 14 supports clamping members 16, which are examples of pressing members. Each clamping member 16 includes a cylindrical core 16*a* that is supported by the rotating shaft 14, an arm 16*b* that extends radially outward from the core 16*a*, and a contact portion 16*c* that extends obliquely rightward with respect to the arm 16*b* from the distal end of the arm 16*b*. In the first exemplary embodiment, three clamping members 16 are supported by the rotating shaft 14 at the same phase with intervals therebetween in the front-back direction. The rotating shaft 14 receives forward and reverse driving force from a stepper motor 17, which is an example of a driving source. Accordingly, the rotating shaft 14 is rotatable in forward and reverse directions by a preset angle. Thus, each clamping member 16 is movable between a retracted position shown by the solid lines in FIG. 6 and an operating position shown by the dashed lines in FIG. 6. At the retracted position, the clamping member 16 is retracted into a cover U4*a* of a body of the finisher U4 and separated from a region through which the sheets S ejected from the compiler tray 1 are transported to and stacked on the stacker tray TH1. At the operating position, which is an example of a pressing position, the clamping member 16 is in contact with the upper surface of the sheets S on the stacker tray TH1 and presses the sheets S.

In FIGS. 4 and 5, the stacker tray TH1, which is an example of a medium ejection portion and which obliquely extends rightward and upward, is disposed downstream of the compiler tray 1 in the sheet transporting direction. A stacking surface TH1*a*, on which the sheets S are stacked, is provided at the top of the stacker tray TH1.

A slider 18, which is an example of a raising-lowering member, is connected to a left end portion of the stacker tray TH. The slider 18 is supported so as to be movable in the up-down direction along guide rails 19, which are examples of guiding portions formed on the finisher U4. A raising-lowering belt 23 looped around rollers 21 and 22, which are an example of a pair of upper and lower rotating members, is disposed on the left side of the slider 18. The slider 18 is fixed to and supported by the raising-lowering belt 23. When the raising-lowering belt 23 is rotated in the forward or reverse direction, the stacker tray TH1 is raised or lowered in the up-down direction.

The stacker tray TH1 and the mechanism for moving the stacker tray TH1 upward and downward may have structures as those described in, for example, Japanese Unexamined Patent Application Publication Nos. 2003-89463 and 2006-69746, and detailed description thereof are thus omitted.

Referring to FIGS. 4 to 6, an upper sensor SNa, which is an example of a first upper-surface detecting member, is disposed above the guide rails 19. The upper sensor SNa detects the stacking surface TH1*a* of the stacker tray TH1 or the uppermost surface of the sheets S on the stacking surface TH1*a*. The upper sensor SNa is disposed at a height at which each clamping member 16 comes into contact with the upper surface of the sheets S on the stacker tray TH1 and presses the sheets S when the clamping member 16 is moved to the operating position. A lower sensor SNb, which is an example of a second upper-surface detecting member, is disposed below the upper sensor SNa with a preset gap therebetween. Similar to the upper sensor SNa, the lower sensor SNb detects, for example, the uppermost surface of the sheets S on the stacking surface TH1*a* of the stacker tray TH1.

Control Section of First Exemplary Embodiment

Figure 7:
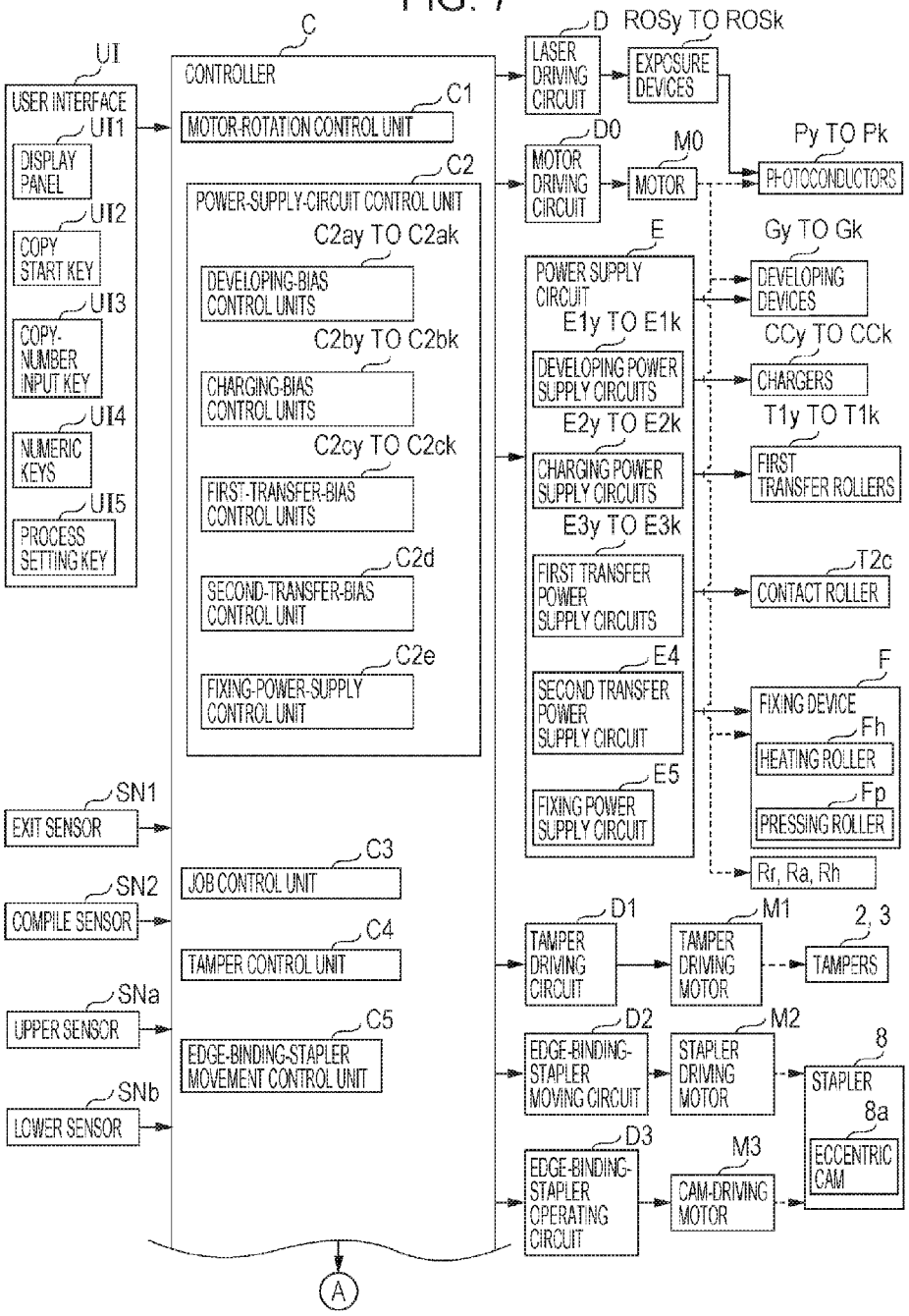
FIG. 7 is a block diagram illustrating functions of a control section of the image forming apparatus according to the first exemplary embodiment.

FIG. 7 is a block diagram illustrating functions of a control section of the image forming apparatus according to the first exemplary embodiment.

Figure 8:
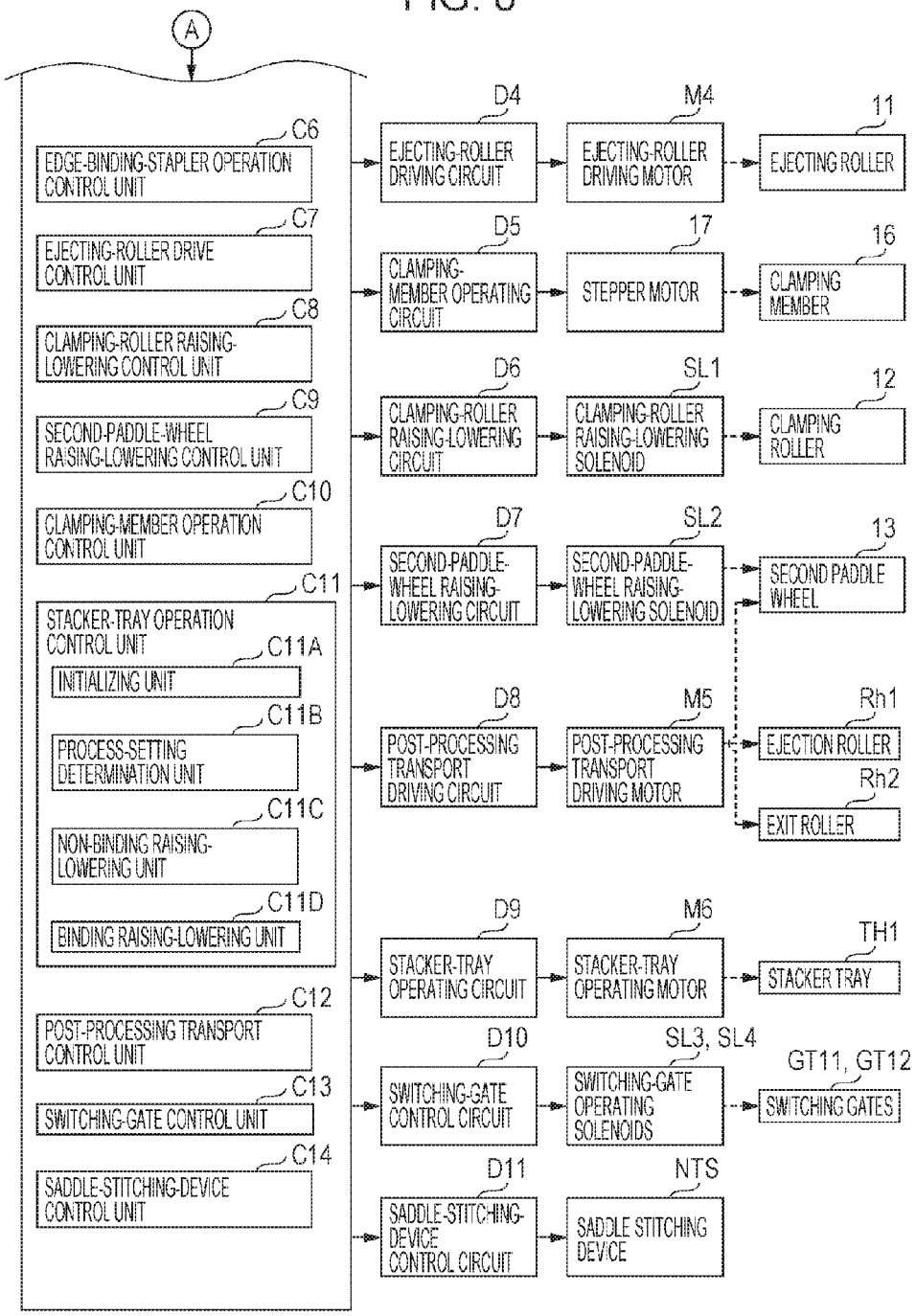
FIG. 8 is a block diagram that continues from the block diagram illustrated in FIG. 7 and illustrates functions of the control section of the image forming apparatus according to the first exemplary embodiment.

FIG. 8 is a block diagram that continues from the block diagram illustrated in FIG. 7 and illustrates functions of the control section of the image forming apparatus according to the first exemplary embodiment.

Referring to FIGS. 7 and 8, the controller C includes an input/output (I/O) interface which receives and transmits signals to and from an external unit and adjusts the input/output signal level; a read only memory (ROM) in which programs, data, etc., for executing necessary processes are stored; a random access memory (RAM) which temporarily stores necessary data; a central processing unit (CPU) that performs processes in accordance with the programs stored in the ROM; and a microcomputer that includes a clock oscillator. Various functions may be realized by executing the programs stored in the ROM.

Signal Input Elements Connected to Controller C

The controller C receives signals output from, for example, the following signal outputting elements UI.

UI: User Interface

The user interface UI includes a display panel UI1, a copy start key UI2, a copy-number input key U13, numeric keys UI4, and a process setting key UI5 through which a process to be performed (for example, saddle stitching, corner binding, side edge binding, alignment only (no binding is performed), or direct ejection to the stacker tray TH1) is set.

SN1: Exit Sensor

The exit sensor SN1 detects sheets S that are transported along the edge-binding transport path SH15 and fed to the compiler tray 1.

SN2: Compile Sensor

The compile sensor SN2 detects the sheets S on the compiler tray 1.

SNa: Upper Sensor

The upper sensor SNa detects the stacking surface TH1*a* of the stacker tray TH1 or the uppermost surface of the sheets S on the stacking surface TH1*a*.

SNb: Lower Sensor

The lower sensor SNb detects the stacking surface TH1*a* of the stacker tray TH1 or the uppermost surface of the sheets S on the stacking surface TH1*a*.

Controlled Elements Connected to Controller C

The controller C outputs control signals to the following controlled elements.

D: Laser Driving Circuit

The laser driving circuit D drives the exposure devices ROSy to ROSk to form electrostatic latent images on the photoconductors Py to Pk.

D0: Motor Driving Circuit

A motor driving circuit D0 drives a motor M0 to rotate the photoconductors Py to Pk, developing rollers (not shown) of the developing devices Gy to Gk, the heating roller Fh, the registration roller Rr, and the transport rollers Ra by using gears (not shown).

E: Power Supply Circuit

The power supply circuit E includes the following power supply circuits.

E1*y* to E1*k*: Developing Power Supply Circuits

Developing power supply circuits E1*y* to E1*k* apply developing biases to the developing rollers (not shown) of the developing devices Gy to Gk.

E2*y* to E2*k*: Charging Power Supply Circuits

Charging power supply circuits E2*y* to E2*k* apply charging biases to the chargers CCy to CCk.

E3*y* to E3*k*: First Transfer Power Supply Circuits

First transfer power supply circuits E3*y* to E3*k* apply first transfer biases to the first transfer rollers T1*y* to T1*k*.

E4: Second Transfer Power Supply Circuit

A second transfer power supply circuit E4 applies a second transfer bias to the contact roller T2*c*.

E5: Fixing Power Supply Circuit

A fixing power supply circuit E5 supplies heating electric power to the heating roller Fh.

D1: Tamper Driving Circuit

A tamper driving circuit D1 controls forward and reverse rotations of a tamper driving motor M1 to operate the tampers 2 and 3.

D2: Edge-Binding-Stapler Moving Circuit

An edge-binding-stapler moving circuit D2 controls forward and reverse rotations of a stapler driving motor M2 to move the stapler 8 along the stapler guide 7.

D3: Edge-Binding-Stapler Operating Circuit

An edge-binding-stapler operating circuit D3 controls a cam-driving motor M3 to rotate an eccentric cam 8*a* so that the stapler 8 ejects a staple (not shown) to bind a stack of sheets together.

D4: Ejecting-Roller Driving Circuit

An ejecting-roller driving circuit D4 controls forward and reverse rotations of an ejecting-roller driving motor M4 to rotate the ejecting roller 11 in the forward and reverse directions.

D5: Clamping-Member Operating Circuit

A clamping-member operating circuit D5 controls forward and reverse rotations of the stepper motor 17 to move each clamping member 16 between the operating position and the retracted position.

D6: Clamping-Roller Raising-Lowering Circuit

A clamping-roller raising-lowering circuit D6 controls the on-off state of a clamping-roller raising-lowering solenoid SL1 to move the clamping roller 12 between the upper position and the lower position.

D7: Second-Paddle-Wheel Raising-Lowering Circuit

A second-paddle-wheel raising-lowering circuit D7 controls the on-off state of a second-paddle-wheel raising-lowering solenoid SL2 to move the second paddle wheel 13 between the upper position and the lower position.

D8: Post-Processing Transport Driving Circuit

A post-processing transport driving circuit D8 controls a post-processing transport driving motor M5 to drive the transport rollers such as the ejection roller Rh1 and the exit roller Rh2.

D9: Stacker-Tray Operating Circuit

A stacker-tray operating circuit D9 controls a stacker-tray operating motor M6 to move the stacker tray TH1 in the up-down direction.

D10: Switching-Gate Control Circuit

A switching-gate control circuit D10 controls switching-gate operating solenoids SL3 and SL4 to move the switching gates GT11 and GT12.

D11: Saddle-Stitching-Device Control Circuit

A saddle-stitching-device control circuit D11 controls a control device of, for example, the stapler of the saddle stitching device NTS to perform saddle stitching on a stack of recording sheets.

Functions of Controller C

The controller C has programs (function realizing units) based on which the controller C performs processes in accordance with the output signals from the signal outputting elements to realize the functions of outputting control signals to the controlled elements. The programs (function realizing units) for realizing the functions of the controller C will now be described.

C1: Motor Rotation Control Unit

A motor rotation control unit C1 controls the motor driving circuit D0 to control the rotations of, for example, the photoconductors Py to Pk, the developing rollers of the developing devices Gy to Gk, and the fixing device F.

C2: Power-Supply-Circuit Control Unit

A power-supply-circuit control unit C2 includes units C2*a* to C2*e*, and controls the power supply circuit E to control the developing biases, the charging biases, the transfer biases, and the on-off state of a heater of the heating roller Fh.

C2*ay* to C2*ak*: Developing-Bias Control Units

Developing-bias control units C2*ay* to C2*ak* control the operations of the developing power supply circuits E1*y* to E1*k* to control the developing biases applied to developing rollers of the developing devices Gy to Gk.

C2*by* to C2*bk*: Charging-Bias Control Units

Charging-bias control units C2*by* to C2*bk* control the operations of the charging power supply circuits E2*y* to E2*k* to control the charging biases applied to the chargers CCy to CCk.

C2*cy* to C2*ck*: First-Transfer-Bias Control Units

First-transfer-bias control units C2*cy* to C2*ck* control the operations of the first transfer power supply circuits E3*y* to E3*k* to control the transfer biases applied to the first transfer rollers T1*y* to T1*k*.

C2*d*: Second-Transfer-Bias Control Unit

A second transfer bias control unit C2*d* controls the operation of the second transfer power supply circuit E4 to control the transfer bias applied to the contact roller T2*c*.

C2*e*: Fixing-Power-Supply Control Unit

A fixing-power-supply control unit C2*e* controls the operation of the fixing power supply circuit E5 to control the on-off state of the heater of the heating roller Fh.

C3: Job Control Unit

A job control unit C3 executes a job, which is an example of an image recording operation, in accordance with an input from the copy start key U12 by controlling the operations of, for example, the exposure devices ROSy to ROSk, the photoconductors Py to Pk, the transfer rollers T1*y* to T1*k*, T2*c*, and the fixing device F.

C4: Tamper Control Unit

A tamper control unit C4 operates the tampers 2 and 3 in accordance with the size of the sheets S fed to the compiler tray 1. More specifically, the tamper control unit C4 operates the tampers 2 and 3 so as to align the side edges of the sheets S fed to the compiler tray 1. The tamper control unit C4 of the first exemplary embodiment operates the tampers 2 and 3 in a "stapling mode", in which corner binding or side edge binding is performed, or an "aligning mode", in which the edges of the sheets S are simply aligned. After the binding process in the "stapling mode", or after the aligning process in the "aligning mode", the tamper control unit C4 causes the tampers 2 and 3 to move the sheet stack on the compiler tray 1 in the width direction to enable offset ejection, so that the sheet stack is ejected to the stacker tray TH1 at a position shifted in the width direction from the sheet stacks on the stacker tray TH1.

C5: Edge-Binding-Stapler Movement Control Unit

An edge-binding-stapler movement control unit C5 controls the edge-binding-stapler moving circuit D2 in accordance with inputs from the process setting key U15 to move the stapler 8 to a home position, an edge-binding stapling position, or a corner-binding stapling position.

C6: Edge-Binding-Stapler Operation Control Unit

An edge-binding-stapler operation control unit C6 controls the edge-binding-stapler operating circuit D3 to operate the stapler and bind a sheet stack together. The edge-binding-stapler operation control unit C6 of the first exemplary embodiment causes the stapler 8 to staple the aligned sheet stack after the stapler 8 is moved to the desired stapling position.

C7: Ejecting-Roller Drive Control Unit

An ejecting-roller drive control unit C7 controls the ejecting-roller driving circuit D4 to rotate the ejecting roller 11 in the forward or reverse direction so that the sheets S are ejected to the stacker tray TH1 or drawn toward the compiler tray 1.

In a "direct ejection mode", in which the sheets S are directly ejected to the stacker tray TH1, the ejecting-roller drive control unit C7 of the first exemplary embodiment causes the ejecting roller 11 to rotate in the forward direction when the sheets S are transported to the compiler tray 1. Thus, the sheets S may be clamped between the ejecting roller 11 and the clamping roller 12 and ejected.

In the "stapling mode" or "aligning mode", the ejecting-roller drive control unit C7 of the first exemplary embodiment causes the ejecting roller 11 to rotate in the reverse direction when the first one of the sheets S to be stacked together is fed to the compiler tray 1, more specifically, after a preset time since the trailing end of the first sheet S in the transporting direction thereof has passed the exit sensor SN1. Thus, the sheet S may be clamped between the ejecting roller 11 and the clamping roller 12 and drawn. When the second and the following sheets S are fed to the compiler tray 1, the ejecting-roller drive control unit C7 stops the ejecting roller 11. After the aligning process or the stapling process is finished and the movement of the sheets S in the width direction by the tampers 2 and 3 is also finished, the ejecting-roller drive control unit C7 causes the ejecting roller 11 to rotate in the forward direction. Thus, the sheets S may be clamped between the ejecting roller 11 and the clamping roller 12 and ejected.

C8: Clamping-Roller Raising-Lowering Control Unit

A clamping-roller raising-lowering control unit C8 controls the clamping-roller raising-lowering circuit D6 to move the clamping roller 12 between the upper position and the lower position so that the clamping roller 12 moves toward and away from the ejecting roller 11. The clamping-roller raising-lowering control unit C8 of the first exemplary embodiment causes the clamping roller 12 to move to the lower position when the ejecting roller 11 rotates in the forward or reverse direction. In the "direct ejection mode", the clamping-roller raising-lowering control unit C8 of the first exemplary embodiment causes the clamping roller 12 to move to the lower position. Thus, the clamping roller 12 may clamp the sheets S together with the ejecting roller 11 that rotates in the forward direction, and the sheets S may be ejected to the stacker tray TH1.

In the "stapling mode" or "aligning mode", the clamping-roller raising-lowering control unit C8 of the first exemplary embodiment causes the clamping roller 12 to move to the lower position when the first one of the sheets S to be stacked together is fed to the compiler tray 1, more specifically, after a preset time since the trailing end of the first sheet S in the transporting direction thereof has passed the exit sensor SN1. Thus, the clamping roller 12 may clamp the sheet S together with the ejecting roller 11 that rotates in the reverse direction, and the sheet S may be drawn toward the first paddle wheel 6. When the second and the following sheets S are fed to the compiler tray 1, the clamping-roller raising-lowering control unit C8 of the first exemplary embodiment causes the clamping roller 12 to move to the upper position so that the clamping roller 12 is separated from the ejecting roller 11.

After the aligning process or the stapling process is finished and the movement of the sheets S in the width direction by the tampers 2 and 3 is also finished, the clamping-roller raising-lowering control unit C8 of the first exemplary embodiment causes the clamping roller 12 to move to the lower position. Thus, the clamping roller 12 may clamp the sheet stack together with the ejecting roller 11 that rotates in the forward direction, and the sheet stack may be ejected to the stacker tray TH1. After the ejection of the sheet stack is finished, the clamping-roller raising-lowering control unit C8 of the first exemplary embodiment causes the clamping roller 12 to move to the upper position.

C9: Second-Paddle-Wheel Raising-Lowering Control Unit

A second-paddle-wheel raising-lowering control unit C9 controls the second-paddle-wheel raising-lowering circuit D7 to move the second paddle wheel 13 between the upper position and the lower position. In the "stapling mode" and the "aligning mode", the second-paddle-wheel raising-lowering control unit C9 of the first exemplary embodiment causes the second paddle wheel 13 to move between the lower position and the upper position in accordance with the times at which the sheets S are fed to the compiler tray 1. More specifically, for each of the second and the following sheets fed to the compiler tray 1, the second paddle wheel 13 is moved to the lower position after a preset time since the trailing end of each sheet S in the transporting direction thereof has passed the exit sensor SN1. Thus, the second paddle wheel 13 is brought into contact with the sheet S and applies a force that draws the sheet S toward the end wall 4. The second-paddle-wheel raising-lowering control unit C9 of the first exemplary embodiment causes the second paddle wheel 13 to move to the upper position after a preset time in which the sheet S is expected to come into contact with the end wall 4. In the "direct ejection mode", the second-paddle-wheel raising-lowering control unit C9 of the first exemplary embodiment causes the second paddle wheel 13 to remain at the upper position.

C10: Clamping-Member Operation Control Unit

A clamping-member operation control unit C10 controls the clamping-member operating circuit D5 to move the clamping member 16 between the operating position and the retracted position. In the "direct ejection mode", the clamping-member operation control unit C10 of the first exemplary embodiment causes the clamping member 16 to remain at the retracted position. In the case where the "direct ejection mode" is not set, that is, in the "stapling mode" or the "aligning mode", the clamping-member operation control unit C10 of the first exemplary embodiment causes the clamping member 16 to move to the operating position when a sheet stack is ejected from the compiler tray 1. Then, the clamping-member operation control unit C10 of the first exemplary embodiment moves the clamping member 16 to the retracted position when the compile sensor SN2 detects that the trailing end of the sheet stack in the transporting direction has passed the compile sensor SN2.

C11: Stacker-Tray Operation Control Unit

A stacker-tray operation control unit C11, which is an example of a medium-ejecting-portion control unit, includes an initializing unit C11A, a process-setting determination unit C11B, a non-binding raising-lowering unit C11C, and a binding raising-lowering unit C11D. The stacker-tray operation control unit C11 controls the stacker-tray operating circuit D9 and moves the stacker tray TH1 upward or downward in accordance with the number of sheets S on the stacker tray TH1.

C11A: Initializing Unit

The initializing unit C11A performs a process of initializing the position of the stacker tray TH1. When the job is started, the initializing unit C11A of the first exemplary embodiment causes the stacker tray TH1 to move upward until the upper sensor SNa detects, for example, the stacking surface TH1*a*. When the upper sensor SNa detects the stacking surface TH1*a*, the initializing unit C11A of the first exemplary embodiment causes the stacker tray TH1 to move downward until the upper sensor SNa stops detecting the stacking surface TH1*a*. Then, when the upper sensor SNa stops detecting the stacking surface TH1*a*, the initializing unit C11A of the first exemplary embodiment causes the stacker tray TH1 to stop.

C11B: Process-Setting Determination Unit

The process-setting determination unit C11B determines whether or not the sheets S are to be ejected to the stacker tray TH1 without being subjected to the stapling process or after being subjected to the stapling process on the basis of the inputs from the process setting key UI5. In the first exemplary embodiment, it is determined that the sheets S are to be ejected to the stacker tray TH1 after being subjected to the stapling process when, for example, "corner binding" or "edge binding" is set, that is, in the "stapling mode". In addition, in the first exemplary embodiment, it is determined that the sheets S are to be ejected to the stacker tray TH1 without being subjected to the stapling process when, for example, "alignment only" or "direct ejection" is set, that is, when the "stapling mode" is not set.

C11C: Non-Binding Raising-Lowering Unit

When the sheets S are ejected to the stacker tray TH1 without being subjected to the binding process, the non-binding raising-lowering unit C11C, which is an example of a first raising-lowering unit, causes the stacker tray TH1 to move to a preset first position at which the uppermost surface of the sheets S on the stacker tray TH1 is in contact with the clamping member 16. When it is determined that the "stapling mode" is not set, the non-binding raising-lowering unit C11C of the first exemplary embodiment controls the upward and downward movement of the stacker tray TH1 on the basis of the detection result obtained by the upper sensor SNa, which is an example of a first position detecting member.

In the case where the "stapling mode" is not set, the non-binding raising-lowering unit C11C of the first exemplary embodiment determines whether or not the stacking surface TH1*a*, for example, is detected by the upper sensor SNa when the position initialization is finished. When it is determined that the stacking surface TH1*a*, for example, is detected by the upper sensor SNa, the non-binding raising-lowering unit C11C of the first exemplary embodiment causes the stacker tray TH1 to move downward until the upper sensor SNa stops detecting the stacking surface TH1*a*. Then, when the upper sensor SNa stops detecting the stacking surface TH1*a*, the non-binding raising-lowering unit C11C of the first exemplary embodiment causes the stacker tray TH1 to stop. This process is repeated until the job is finished.

C11D: Binding Raising-Lowering Unit

When the sheets S are ejected to the stacker tray TH1 after being subjected to the binding process, the binding raising-lowering unit C11D, which is an example of a second raising-lowering unit, causes the stacker tray TH1 to move to a preset second position that is below the first position and at which the uppermost surface of the sheets S on the stacker tray TH1 is separated from the clamping member 16. When it is determined that the "stapling mode" is set, the binding raising-lowering unit C11D of the first exemplary embodiment controls the upward and downward movement of the stacker tray TH1 on the basis of the detection result obtained by the lower sensor SNb, which is an example of a second position detecting member. Thus, the binding raising-lowering unit C11D of the first exemplary embodiment differs from the non-binding raising-lowering unit C11C in that the upward and downward movement of the stacker tray TH1 is controlled on the basis of the detection result of the lower sensor SNb instead of the upper sensor SNa. The binding raising-lowering unit C11D is similar to the non-binding raising-lowering unit C11C in other respects, and detailed description thereof is thus omitted.

C12: Post-Processing Transport Control Unit

A post-processing transport control unit C12 controls the post-processing transport driving circuit D8 to transport the sheets S in accordance with the time when the sheets S are fed to the finisher U4.

C13: Switching-Gate Control Unit

A switching-gate control unit C13 controls the switching gates GT11 and GT12 to transport the sheets S fed to the feeding path SH11 to one of the saddle-stitching transport path SH13, the ejection path SH14, and the edge-binding transport path SH15 in accordance with the inputs from the process setting key U15.

C14: Saddle-Stitching-Device Control Unit

A saddle-stitching-device control unit C14 controls the saddle-stitching-device control circuit D11 so that the saddle stitching device NTS performs saddle stitching on the sheet stack when saddle stitching is set according to the inputs from the process setting key UI5.

Flowchart of First Exemplary Embodiment

The procedure of controlling the printer U of the first exemplary embodiment will now be described with reference to a flowchart.

Flowchart of Stacker-Tray Raising-Lowering Process

Figure 9:
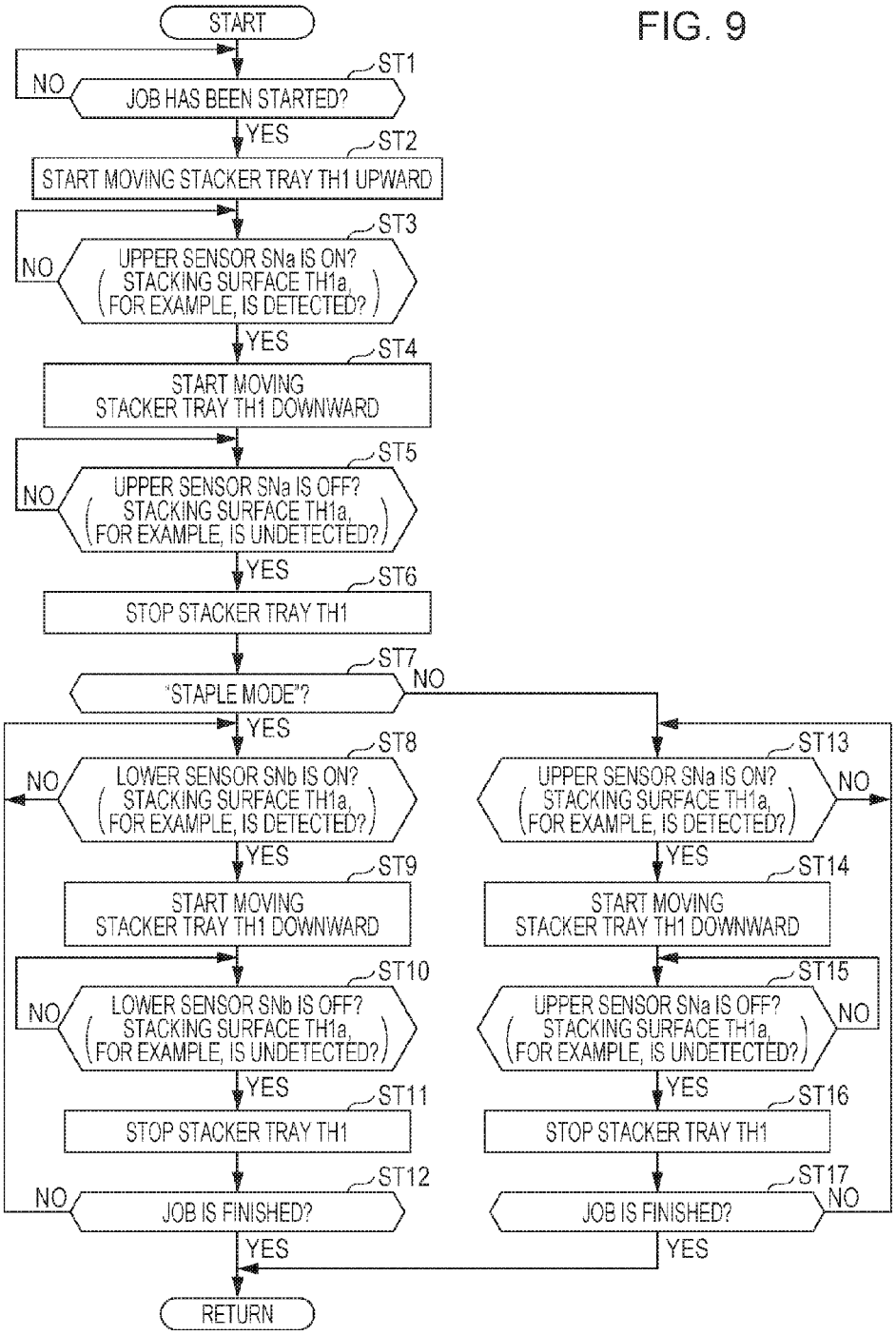
FIG. 9 is a flowchart of a stacker-tray raising-lowering process according to the first exemplary embodiment.

FIG. 9 is a flowchart of a stacker-tray raising-lowering process according to the first exemplary embodiment.

Each step ST in the flowchart of FIG. 9 is executed in accordance with the programs stored in the controller C of the printer U. This process is executed in parallel with other processes of the printer U.

The flowchart of FIG. 9 is started when the power of the printer U is turned on.

In ST1 of FIG. 9, it is determined whether or not the job has been started. When the result of the determination is Yes (Y), the process proceeds to ST2. When the result of the determination is No (N), ST1 is repeated.

In ST2, the stacker tray TH1 starts to move upward. Then, the process proceeds to ST3.

In ST3, it is determined whether or not the stacking surface TH1*a*, for example, is detected by the upper sensor SNa, that is, whether or not the upper sensor SNa is ON. When the result of the determination is Yes (Y), the process proceeds to ST4. When the result of the determination is No (N), ST3 is repeated.

In ST4, the stacker tray TH1 starts to move downward. Then, the process proceeds to ST5.

In ST5, it is determined whether or not the stacking surface TH1*a*, for example, is undetected by the upper sensor SNa, that is, whether or not the upper sensor SNa is OFF. When the result of the determination is Yes (Y), the process proceeds to ST6. When the result of the determination is No (N), ST5 is repeated.

In ST6, the stacker tray TH1 is stopped. Then, the process proceeds to ST7.

In ST7, it is determined whether or not the "stapling mode" is set. When the result of the determination is Yes (Y), the process proceeds to ST8. When the result of the determination is No (N), the process proceeds to ST13.

In ST8, it is determined whether or not the stacking surface TH1*a*, for example, is detected by the lower sensor SNb, that is, whether or not the lower sensor SNb is ON. When the result of the determination is Yes (Y), the process proceeds to ST9. When the result of the determination is No (N), ST8 is repeated.

In ST9, the stacker tray TH1 starts to move downward. Then, the process proceeds to ST10.

In ST10, it is determined whether or not the stacking surface TH1*a*, for example, is undetected by the lower sensor SNb, that is, whether or not the lower sensor SNb is OFF. When the result of the determination is Yes (Y), the process proceeds to ST11. When the result of the determination is No (N), ST10 is repeated.

In ST11, the stacker tray TH1 is stopped. Then, the process proceeds to ST12.

In ST12, it is determined whether or not the job is finished. When the result of the determination is Yes (Y), the process returns to ST1. When the result of the determination is No (N), the process returns to ST8.

In ST13, it is determined whether or not the stacking surface TH1*a*, for example, is detected by the upper sensor SNa, that is, whether or not the upper sensor SNa is ON. When the result of the determination is Yes (Y), the process proceeds to ST14. When the result of the determination is No (N), ST13 is repeated.

In ST14, the stacker tray TH1 starts to move downward. Then, the process proceeds to ST15.

In ST15, it is determined whether or not the stacking surface TH1*a*, for example, is undetected by the upper sensor SNa, that is, whether or not the upper sensor SNa is OFF. When the result of the determination is Yes (Y), the process proceeds to ST16. When the result of the determination is No (N), ST15 is repeated.

In ST16, the stacker tray TH1 is stopped. Then, the process proceeds to ST17.

In ST17, it is determined whether or not the job is finished. When the result of the determination is Yes (Y), the process returns to ST1. When the result of the determination is No (N), the process returns to ST13.

Flowchart of Clamping-Member Controlling Process

Figure 10:
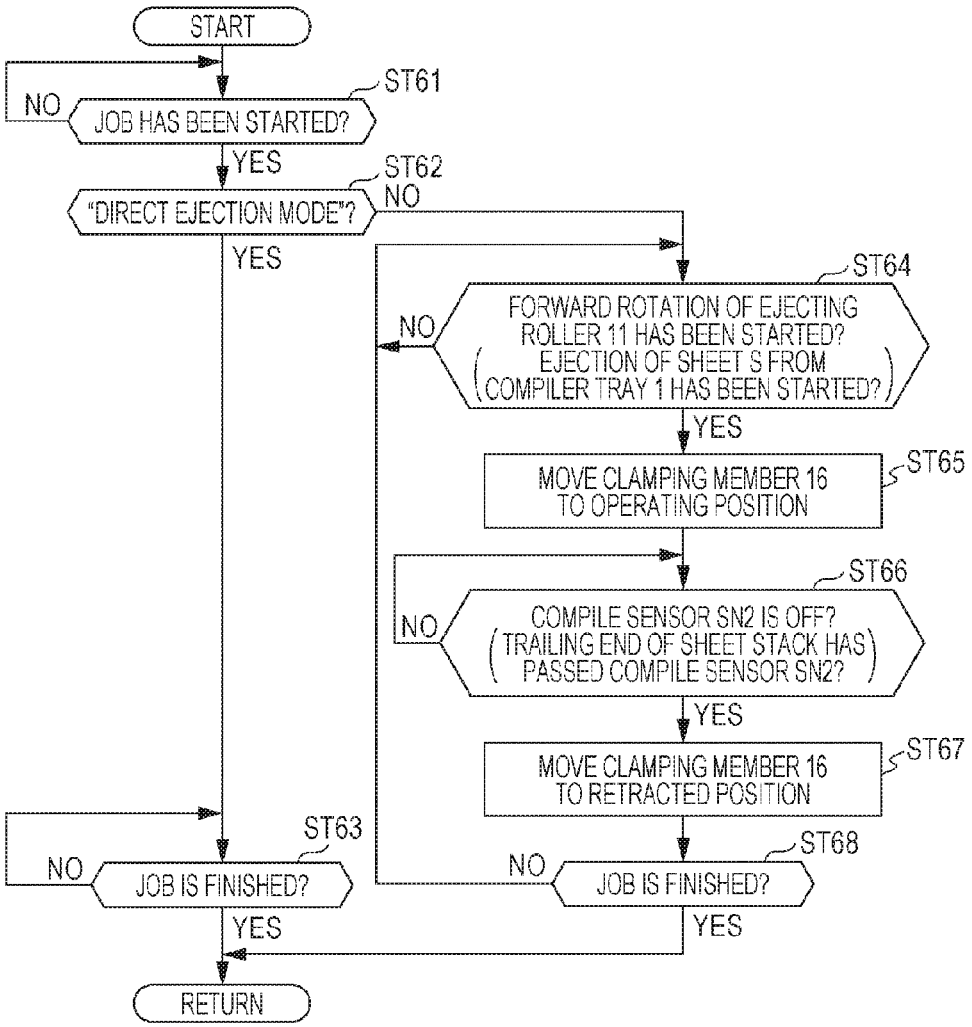
FIG. 10 is a flowchart of a clamping-member controlling process according to the first exemplary embodiment.

FIG. 10 is a flowchart of a clamping-member controlling process according to the first exemplary embodiment.

Each step ST in the flowchart of FIG. 10 is executed in accordance with the programs stored in the controller C of the printer U. This process is executed in parallel with other processes of the printer U.

The flowchart of FIG. 10 is started when the power of the printer U is turned on.

In ST61 of FIG. 10, it is determined whether or not the job has been started. When the result of the determination is Yes (Y), the process proceeds to ST62. When the result of the determination is No (N), ST61 is repeated.

In ST62, it is determined whether or not the "direct ejection mode" is set. When the result of the determination is Yes (Y), the process proceeds to ST63. When the result of the determination is No (N), the process proceeds to ST64.

In ST63, it is determined whether or not the job is finished. When the result of the determination is Yes (Y), the process returns to ST61. When the result of the determination is No (N), ST63 is repeated.

In ST64, it is determined whether or not the ejection of the sheets S from the compiler tray 1 has been started, that is, whether or not forward rotation of the ejecting roller 11 has been started. When the result of the determination is Yes (Y), the process proceeds to ST65. When the result of the determination is No (N), ST64 is repeated.

In ST65, each clamping member 16 is moved to the operating position. Then, the process proceeds to ST66.

In ST66, it is determined whether or not the trailing end of the sheet stack has passed the compile sensor SN2, that is, whether or not the compile sensor SN2 is OFF. When the result of the determination is Yes (Y), the process proceeds to ST67. When the result of the determination is No (N), ST66 is repeated.

In ST67, each clamping member 16 is moved to the retracted position. Then, the process proceeds to ST68.

In ST68, it is determined whether or not the job is finished. When the result of the determination is Yes (Y), the process returns to ST61. When the result of the determination is No (N), the process returns to ST64.

Operation of First Exemplary Embodiment

In the printer U according to the first exemplary embodiment having the above-described structure, the sheets S having images recorded thereon by the printer body U3 are fed to the finisher U4. The sheets S fed to the finisher U4 are transported to one of the top tray TH0, the saddle stitching device NTS, and the edge binding device HTS depending on the settings input through the process setting key UI5. More specifically, in the first exemplary embodiment, the sheets S are transported to the top tray TH0 in accordance with the initial settings when no input has been made through the process setting key UI5. When saddle stitching is set through the process setting key UI5, the sheets S are transported to the saddle stitching device NTS and ejected to the saddle-stitching stacker tray TH2. When alignment only, direct ejection to the stacker tray TH1, corner binding, or side edge binding is set through the process setting key UI5, the sheets S are transported to the edge binding device HTS and ejected to the stacker tray TH1 that is movable upward and downward.

More specifically, in the finisher U4 according to the first exemplary embodiment, when the "aligning mode", in which the sheets S are simply aligned, is set, the sheets S transported to the edge-binding transport path SH15 are fed to the compiler tray 1 by the exit roller Rh2. The ejecting roller 11 is rotated in the reverse direction after a preset time since the first one of the sheets S to be stacked together has passed the exit sensor SN1. Also, the clamping roller 12 is moved downward. Thus, the first sheet S fed to the compiler tray 1 is clamped between the ejecting roller 11 and the clamping roller 12 and drawn toward the first paddle wheel 6. After that, the ejecting roller 11 is stopped and the clamping roller 12 is moved upward away from the ejecting roller 11. The first paddle wheel 6 causes the sheet S to abut against the end wall 4, thereby aligning the trailing edge of the sheet S in the transporting direction thereof. When the trailing edge of the sheet S in the transporting direction thereof is aligned, the tampers 2 and 3 are activated to align the edges of the sheet S in the width direction.

When the second and the following sheets S to be stacked together are fed to the compiler tray 1, the second paddle wheel 13 is moved downward after a preset time since each sheet S has passed the exit sensor SN1. The second paddle wheel 13 draws the sheet S placed on the sheets S that have already been fed to the compiler tray 1 toward the first paddle wheel 6. Thus, the second and the following sheets S are also caused to abut against the end wall 4 by the first paddle wheel 6, so that the trailing edges of the sheets S in the transporting direction thereof are aligned. When the trailing edges of the sheets S in the transporting direction thereof are aligned, the tampers 2 and 3 are activated to align the edges of the sheets S in the width direction. Thus, in the edge binding device HTS of the first exemplary embodiment, all of the sheets S to be stacked together are fed to the compiler tray 1 and aligned.

When the alignment is finished, the tampers 2 and 3 are activated so as to move the aligned sheets S, that is, the aligned sheet stack, in the width direction so that the sheet stack is shifted from the sheet stacks that have already been ejected to the stacker tray TH1. Then, the clamping roller 12 is moved downward and clamps the sheet stack together with the ejecting roller 11. Then, when the ejecting roller 11 is rotated in the forward direction, offset ejection of the sheet stack to the stacker tray TH1 is performed.

Figure 11A:
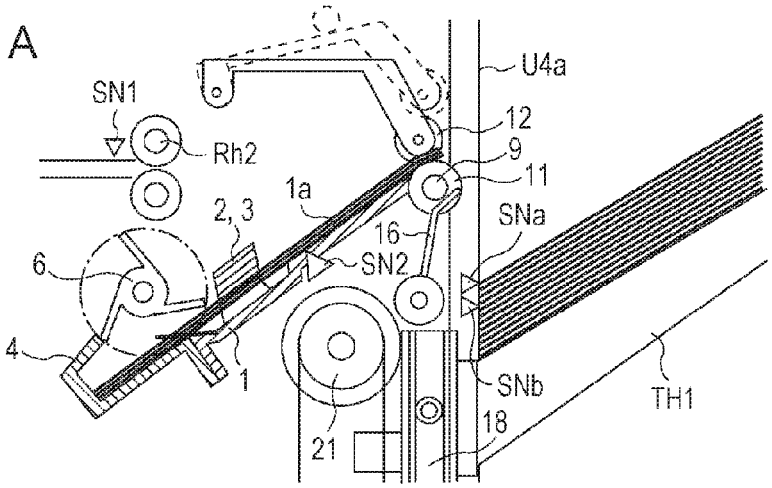
FIGS. 11A to 11C illustrate an aligning mode according to the first exemplary embodiment, where
Figure 11B:
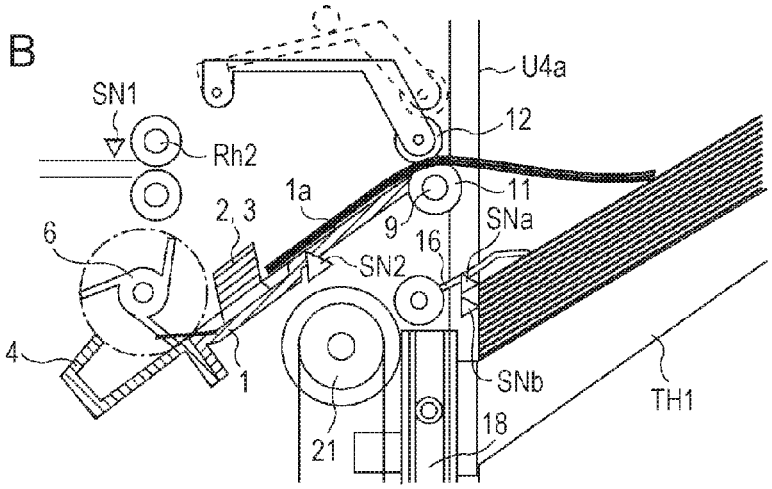
Figure 11C:
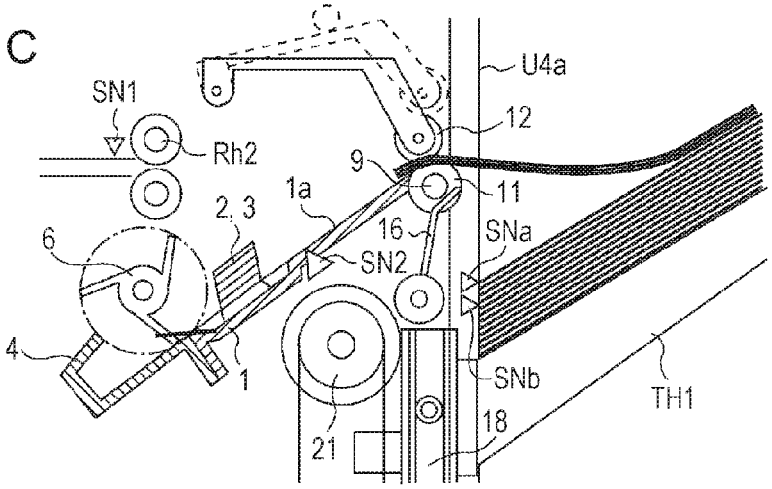

FIGS. 11A to 11C illustrate the aligning mode according to the first exemplary embodiment. FIG. 11A illustrates the state before the start of ejection of the sheet stack to the stacker tray TH1. FIG. 11B illustrates the state in which the ejection of the sheet stack to the stacker tray TH1 is performed after the state of FIG. 11A. FIG. 11C illustrates the state in which the sheet stack has passed the compile sensor SN2 after the state of FIG. 11B.

Referring to FIGS. 11A to 11C, in the "aligning mode", the upward and downward movement of the stacker tray TH1 is controlled on the basis of the detection result of the upper sensor SNa. More specifically, the stacker tray TH1 is controlled so that the uppermost surface of the sheets S on the stacking surface TH1*a*, for example, is at the detection position of the upper sensor SNa.

In the "aligning mode" according to the first exemplary embodiment, each clamping member 16 is moved to the operating position when the ejection of the sheet stack is started. Accordingly, in FIG. 11B, the clamping member 16 is in contact with the sheets S on the stacking surface TH1*a* and the sheets S are pressed between the clamping member 16 and the stacking surface TH1*a*. Accordingly, even when the leading end of the sheet stack ejected from the compiler tray 1 in the ejecting direction moves downward due to its own weight and the sheet stack is ejected while being in contact with the uppermost surface of the sheet stacks that have already been ejected, the uppermost sheet S is not easily dragged by the sheet stack that is being ejected. Thus, in the first exemplary embodiment, the sheets S on the stacker tray TH1 are not easily disarranged.

Referring to FIG. 11C, when the trailing end of the ejected sheet stack in the ejecting direction passes the compile sensor SN2, the clamping member 16 is moved to the retracted position. Accordingly, when the sheet stack ejected from the compiler tray 1 falls onto the stacker tray TH1, the sheet stack does not come into contact with the clamping member 16 and is not easily displaced. Therefore, the ejected sheet stack easily falls onto the stacker tray TH1 at a preset position. As a result, in the first exemplary embodiment, the sheets S are not easily disarranged and the stacking failure of the sheets S is suppressed in the aligning mode.

In the finisher U4 according to the first exemplary embodiment, in the "stapling mode", in which edge binding or corner binding is performed, sheets S to be bound together are stacked on the compiler tray 1 and aligned as in the "aligning mode". After the alignment, the stapler 8 moves to the edge-binding stapling position or the corner-binding stapling position in accordance with the settings, and binds the aligned sheet stack together with a staple. After the binding process, the tampers 2 and 3 and the rollers 11 and 12 are activated to perform offset ejection of the sheet stack to the stacker tray TH1.

Figure 12A:
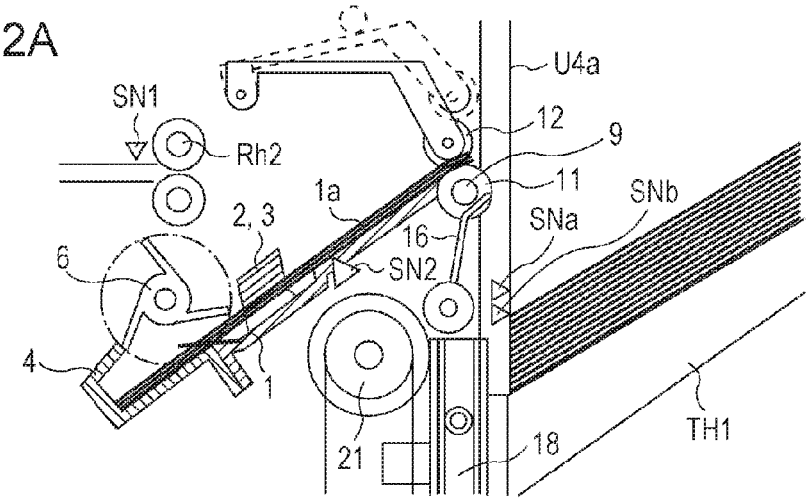
FIGS. 12A to 12C illustrate a stapling mode according to the first exemplary embodiment, where
Figure 12B:
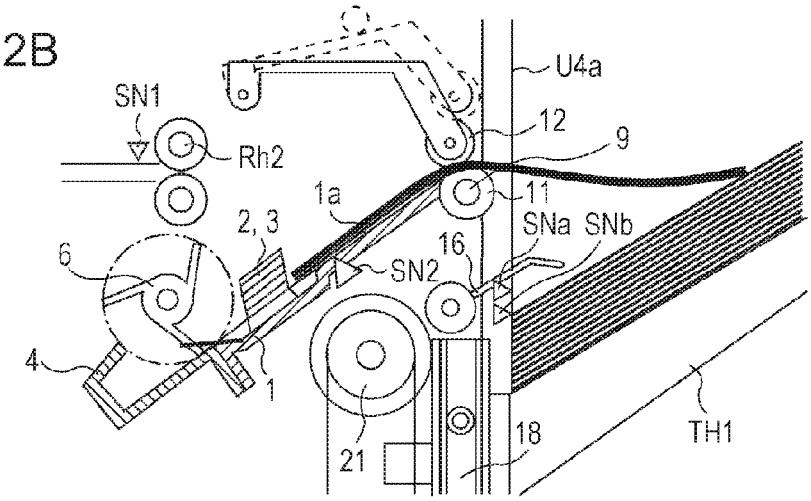
Figure 12C:
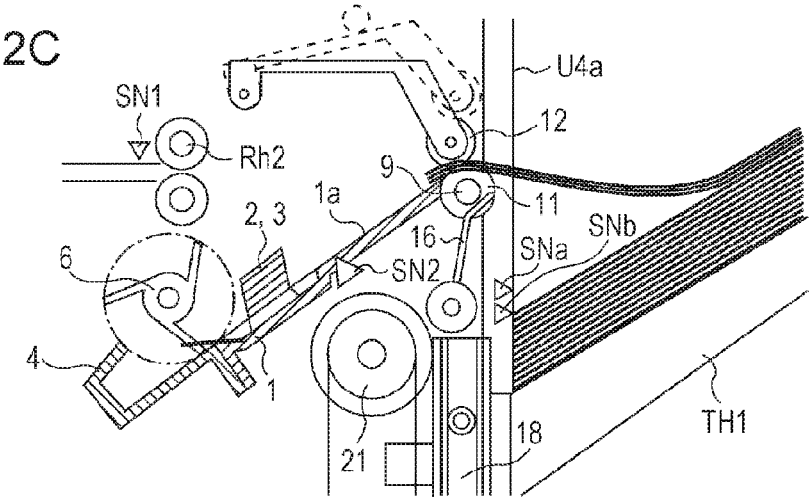

FIGS. 12A to 12C illustrate the stapling mode according to the first exemplary embodiment. FIG. 12A illustrates the state before the start of ejection of the sheet stack to the stacker tray TH'. FIG. 12B illustrates the state in which the ejection of the sheet stack to the stacker tray TH1 is performed after the state of FIG. 12A. FIG. 12C illustrates the state in which the sheet stack has passed the compile sensor SN2 after the state of FIG. 12B.

In the "stapling mode" according to the first exemplary embodiment, the upward and downward movement of the stacker tray TH1 is controlled similarly to the "aligning mode" except that the movement of the stacker tray TH1 is controlled on the basis of the detection result of the lower sensor SNb instead of the upper sensor SNa. More specifically, the stacker tray TH1 is controlled so that the uppermost surface of the sheets S that have already been ejected, for example, is at the detection position of the lower sensor SNb. Each clamping member 16 is moved between the operating position and the retracted position similarly to the "aligning mode".

Thus, referring to FIG. 12B, in the "stapling mode" of the first exemplary embodiment, when the ejection of a sheet stack from the compiler tray 1 is started, the stacker tray TH1 is located at a position lower than that in the "aligning mode" on the basis of the detection result of the lower sensor SNb. The clamping member 16 moves to the same operating position as that in the "aligning mode". Accordingly, since the stacker tray TH1 is at the lower position, the clamping member 16 at the operating position is farther from the sheets S on the stacking surface TH1*a* than in the "aligning mode", but is close to the sheets S.

In general, the clamping member presses the uppermost surface of the sheets S with a force strong enough to prevent the sheets S from being dragged when they are pulled. In recent years, there has been a demand for image forming apparatuses capable of processing a greater number of sheets in unit time, that is, image forming apparatuses with higher productivity. Accordingly, components, such as the clamping member, are generally required to move at a higher speed. Therefore, when the clamping member comes into contact with the sheets S, a large impact tends to occur and impact noise is easily generated.

Japanese Unexamined Patent Application Publication No. 2012-184114 describes a technology for transporting a sheet stack subjected to a stapling process by clamping a trailing end of the sheet stack in the ejecting direction. Japanese Unexamined Patent Application Publication No. 2001-322762 describes a technology for controlling upward and downward movement of a stacker tray on the basis of a detection position of a single sensor. Japanese Unexamined Patent Application Publication Nos. 2012-184114 and 2001-322762 do not describe a technology of separating a clamping member from a sheet stack subjected to a binding process. Therefore, according to the technologies described in Japanese Unexamined Patent Application Publication Nos. 2012-184114 and 2001-322762, the clamping member comes into contact with the sheet stack subjected to a binding process. This means that, according to the technologies described in Japanese Unexamined Patent Application Publication Nos. 2012-184114 and 2001-322762, there is a risk that noise is easily generated.

In contrast, in the "stapling mode" of the first exemplary embodiment, the clamping member 16 may be easily disposed so as to be separated from the sheets S on the stacking surface TH1*a* when the clamping member 16 is moved to the operating position. Therefore, in the "stapling mode", unlike the case in which the clamping member 16 comes into contact with and presses the sheet stacks, the clamping member 16 does not easily hit the sheets S and the noise is suppressed.

In this case, when a sheet stack is ejected from the compiler tray 1, the sheet stacks that have already been ejected to the stacker tray TH1 are not pressed by the clamping member 16. However, in the "stapling mode", the sheet stacks ejected to and placed on the stacker tray TH1 are subjected to the binding process. The sheet stacks subjected to the binding process are heavier than individual sheets S, and are not easily dragged even when the uppermost sheet S is pulled. Therefore, in the "stapling mode", the sheet stacks are not easily disarranged even when the clamping member 16 is separated from the sheet stacks. Accordingly, in the first exemplary embodiment, the sheets S ejected to the stacker tray TH1 are not easily disarranged, and the noise is reduced from that in the case where the sheet stacks ejected to the stacker tray TH1 after being subjected to the binding process are pressed by the clamping member 16.

In the "stapling mode" of the first exemplary embodiment, the clamping member 16 is moved to the operating position. When the noise is to be further reduced, the clamping member 16 may be retained at the retracted position instead of being driven. However, when a sheet stack is ejected to the stacker tray TH1, the sheet stack may be placed such that the trailing end thereof in the ejecting direction leans against a portion of the cover U4*a* of the finisher U4 that is disposed below the ejecting roller 11. When the ejection of sheet stacks is continuously performed without correcting the position of the leaning sheet stack, there is a risk that the stacker tray TH1 will be excessively moved downward or a sheet stack will be placed on the leaning sheet stack. Thus, the stacking performance may be degraded.

In contrast, in the "stapling mode" according to the first exemplary embodiment, the clamping member 16 is moved to the operating position. Therefore, when there is a sheet stack that leans against the cover U4*a*, the clamping member 16 easily comes into contact with the trailing end of the leaning sheet stack in the ejecting direction, and the trailing end of the leaning sheet stack in the ejecting direction is easily removed from the cover U4*a*. Thus, the position of the leaning sheet stack is easily corrected. Accordingly, in the first exemplary embodiment, the risk that the stacking failure of the sheet stacks will occur is lower than that in the case where the clamping member 16 is retained at the retracted position. As described above, in the "stapling mode" of the first exemplary embodiment, when the ejected sheet stacks are not arranged in an orderly manner in the stacking direction, for example, when there is a sheet stack that leans against the cover U4*a*, the clamping member 16 comes into contact with the sheet stacks when the clamping member 16 is moved to the operating position. When the ejected sheet stacks are arranged in an orderly manner, the clamping member 16 does not come into contact with the sheet stacks.

In the printer U of the first exemplary embodiment, in the "direct ejection mode", when a sheet S transported along the edge-binding transport path SH15 is fed to the compiler tray 1 by the exit roller Rh2, the sheet S is clamped between the ejecting roller 11, which is rotated in the forward direction, and the clamping roller 12, which is moved downward, and is directly ejected to the stacker tray TH1. At this time, similarly to the "aligning mode", the upward and downward movement of the stacker tray TH1 is controlled on the basis of the detection result obtained by the upper sensor SNa. The clamping member 16 is not driven and retained at the retracted position. In the "direct ejection mode", the sheets S are ejected one at a time. The ejected sheet S is lighter than the sheet stacks, and is easily ejected to a position far from the compiler tray 1 due to the momentum of the sheet S ejected from the rollers 11 and 12. Therefore, the trailing end of the sheet S in the ejecting direction tends to fall to a position separated from the cover U4*a*, and does not easily lean against the cover U4*a*. For this reason, in the "direct ejection mode" of the first exemplary embodiment, the clamping member 16 is not driven so that the noise is reduced.

Second Exemplary Embodiment

A second exemplary embodiment of the present invention will now be described. In the second exemplary embodiment, components corresponding to those in the first exemplary embodiment are denoted by the same reference numerals, and detailed description thereof is thus omitted.

This exemplary embodiment differs from the first exemplary embodiment in the points described below, but is similar to the first exemplary embodiment in other points.

Figure 13:
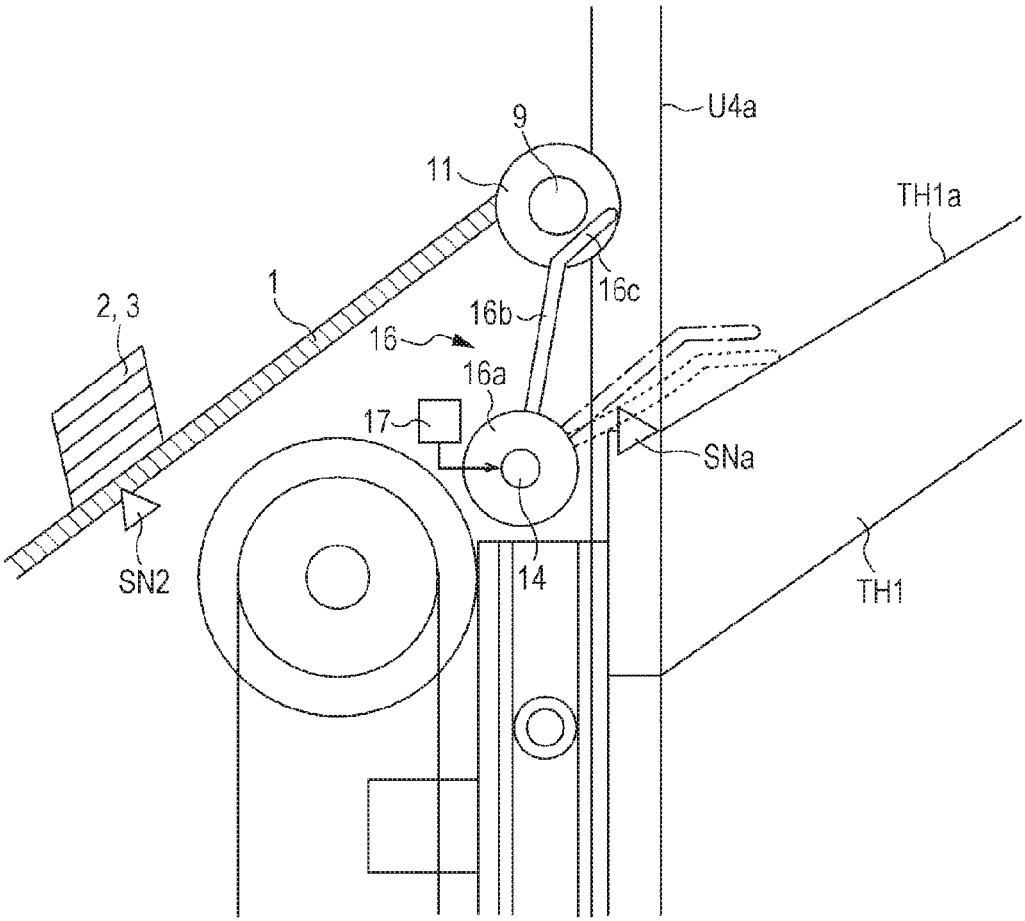
FIG. 13 illustrates a clamping member according to a second exemplary embodiment of the present invention, and corresponds to FIG. 6 illustrating the first exemplary embodiment.

FIG. 13 illustrates a clamping member 16 according to the second exemplary embodiment of the present invention, and corresponds to FIG. 6 illustrating the first exemplary embodiment.

Referring to FIG. 13, in the second exemplary embodiment, the number of positions to which the clamping member 16 is movable is greater than that in the first exemplary embodiment. More specifically, the clamping member 16 of the second exemplary embodiment is movable to an operating position, which is similar to that in the first exemplary embodiment and shown by the solid lines in FIG. 13, a retracted position, which similar to that in the first exemplary embodiment and shown by the dashed lines in FIG. 13, and a removing position, which is shown by one-dot chain line in FIG. 13 and located between the operating position and the retracted position. The removing position, which is an example of a close position, is set to a position where the clamping member 16 is separated from the sheets S on the stacker tray TH1 but is close to the sheets S on the stacker tray TH1.

In the second exemplary embodiment, the lower sensor SNb of the first exemplary embodiment is omitted. Accordingly, in the second exemplary embodiment, the stacker tray TH1 is moved upward and downward in accordance with the detection result obtained by the upper sensor SNa.

Control Section of Second Exemplary Embodiment

Figure 14:
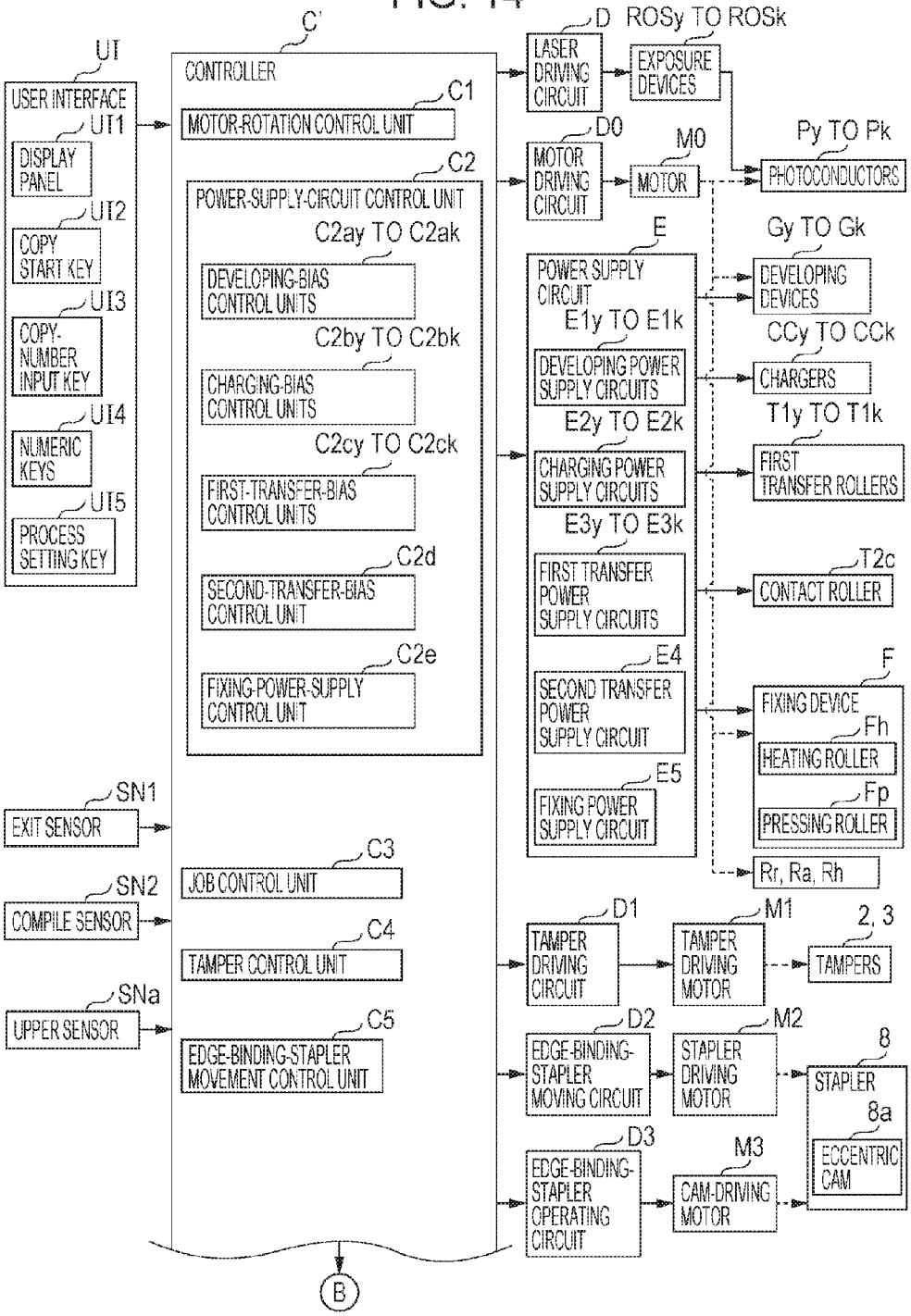
FIG. 14 is a block diagram illustrating functions of a control section of an image forming apparatus according to the second exemplary embodiment.

FIG. 14 is a block diagram illustrating functions of a control section of an image forming apparatus according to the second exemplary embodiment.

Figure 15:
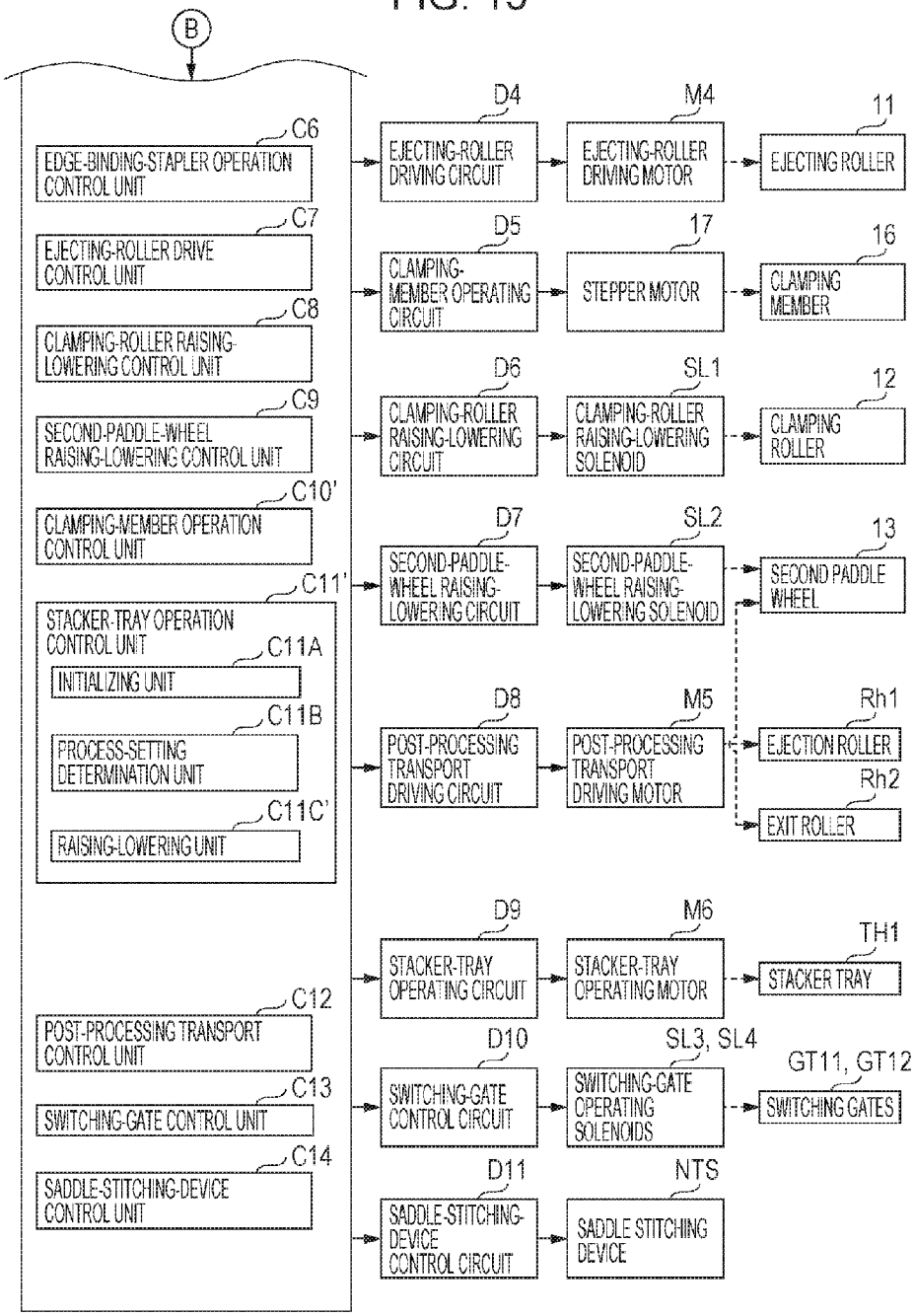
FIG. 15 is a block diagram that continues from the block diagram illustrated in FIG. 14 and illustrates functions of the control section of the image forming apparatus according to the second exemplary embodiment.

FIG. 15 is a block diagram that continues from the block diagram illustrated in FIG. 14 and illustrates functions of the control section of the image forming apparatus according to the second exemplary embodiment. Signal Input Elements Connected to Controller C'

Referring to FIGS. 14 and 15, the second exemplary embodiment differs from the first exemplary embodiment in that the lower sensor SNb is omitted.

Functions of Controller C'

A controller C' of the second exemplary embodiment includes a clamping-member operation control unit C10' and a stacker-tray operation control unit C11' of the second exemplary embodiment in place of the clamping-member operation control unit C10 and the stacker-tray operation control unit C11 of the first exemplary embodiment.

C10': Clamping-Member Operation Control Unit

The clamping-member operation control unit C10' of the second exemplary embodiment controls the clamping-member operating circuit D5 to move the clamping member 16 between the operating position, the retracted position, and the removing position. The second exemplary embodiment differs from the first exemplary embodiment in that the clamping-member operation control unit C10' moves the clamping member 16 to the removing position in the "stapling mode". In the first exemplary embodiment, the clamping member 16 is moved between the operating position and the retracted position in the "stapling mode". In contrast, in the second exemplary embodiment, the clamping member 16 is moved between the removing position and the retracted position in the "stapling mode". In the "direct ejection mode" and the "aligning mode", the clamping-member operation control unit C10' performs control operations similar to those in the first exemplary embodiment. Therefore, the description of the control operations performed in the "direct ejection mode" and the "aligning mode" is omitted.

C11': Stacker-Tray Operation Control Unit

The stacker-tray operation control unit C11' of the second exemplary embodiment differs from the stacker-tray operation control unit C11 of the first exemplary embodiment in that the stacker-tray operation control unit C11' includes a raising-lowering unit C11C' in place of the non-binding raising-lowering unit C11C and the binding raising-lowering unit C11D of the first exemplary embodiment.

C11C': Raising-Lowering Unit

The raising-lowering unit C11C', which is an example of a third raising-lowering unit, of the second exemplary embodiment controls the upward and downward movement of the stacker tray TH1 on the basis of the detection result obtained by the upper sensor SNa irrespective of whether or not the "stapling mode" is set. The non-binding raising-lowering unit C11C and the binding raising-lowering unit C11D according to the first exemplary embodiment control the upward and downward movement of the stacker tray TH1 on the basis of the detection result obtained by the lower sensor SNb in the "stapling mode". In contrast, the raising-lowering unit C11C' of the second exemplary embodiment controls the upward and downward movement of the stacker tray TH1 on the basis of the detection result obtained by the upper sensor SNa not only in the "direct ejection mode" and the "aligning mode" but also in the "stapling mode".

Flowchart of Second Exemplary Embodiment

The procedure of controlling the printer U of the second exemplary embodiment will now be described with reference to a flowchart.

Flowchart of Stacker-Tray Raising-Lowering Process

Figure 16:
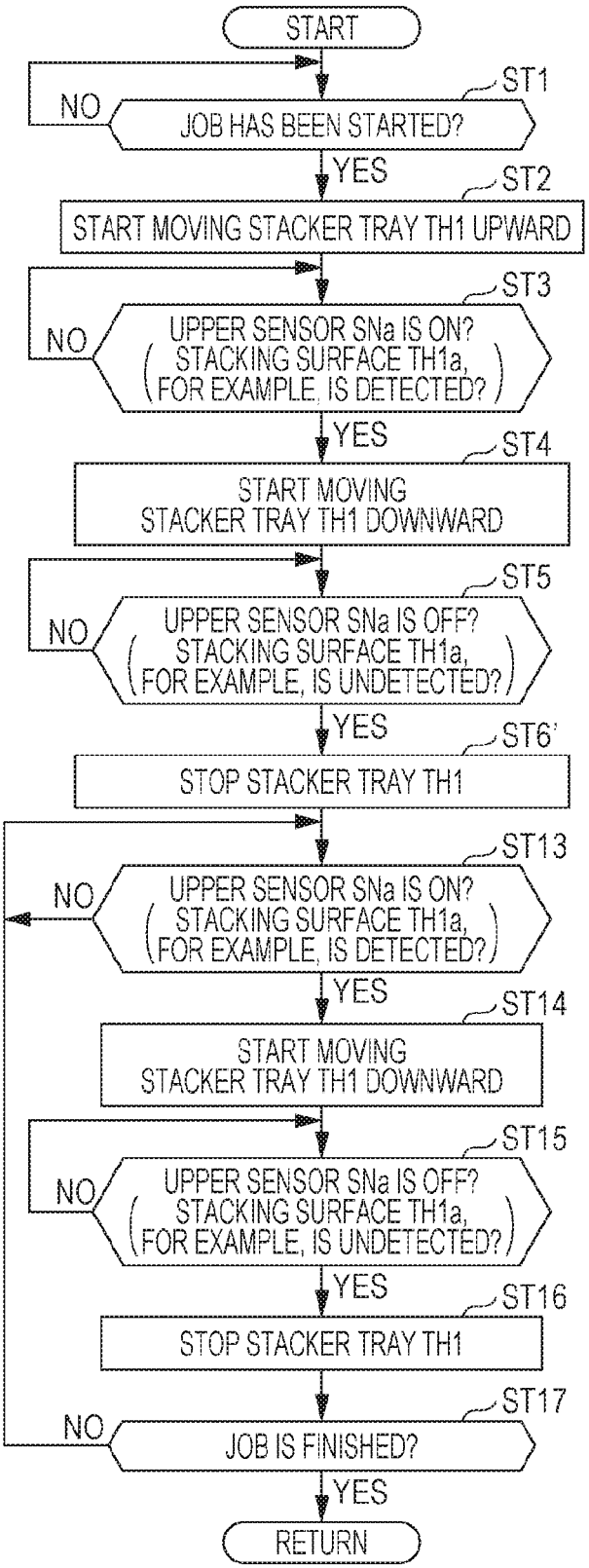
FIG. 16 is a flowchart of a stacker-tray raising-lowering process according to the second exemplary embodiment, and corresponds to FIG. 9 illustrating the first exemplary embodiment.

FIG. 16 is a flowchart of a stacker-tray raising-lowering process according to the second exemplary embodiment, and corresponds to FIG. 9 illustrating the first exemplary embodiment.

Referring to FIG. 16, in the stacker-tray raising-lowering process of the second exemplary embodiment, ST6' is executed instead of ST6 to ST12 in the stacker-tray raising-lowering process of the first exemplary embodiment. In the second exemplary embodiment, ST6' differs from ST6 in the first exemplary embodiment in that the process proceeds to ST13. In the stacker-tray raising-lowering process of the second exemplary embodiment, ST7 to ST12 of the first exemplary embodiment are not executed, and the process proceeds to ST13 from ST6'. The stacker-tray raising-lowering process of the second exemplary embodiment is similar to the stacker-tray raising-lowering process according to the first exemplary embodiment in other respects.

Flowchart of Clamping-Member Controlling Process

Figure 17:
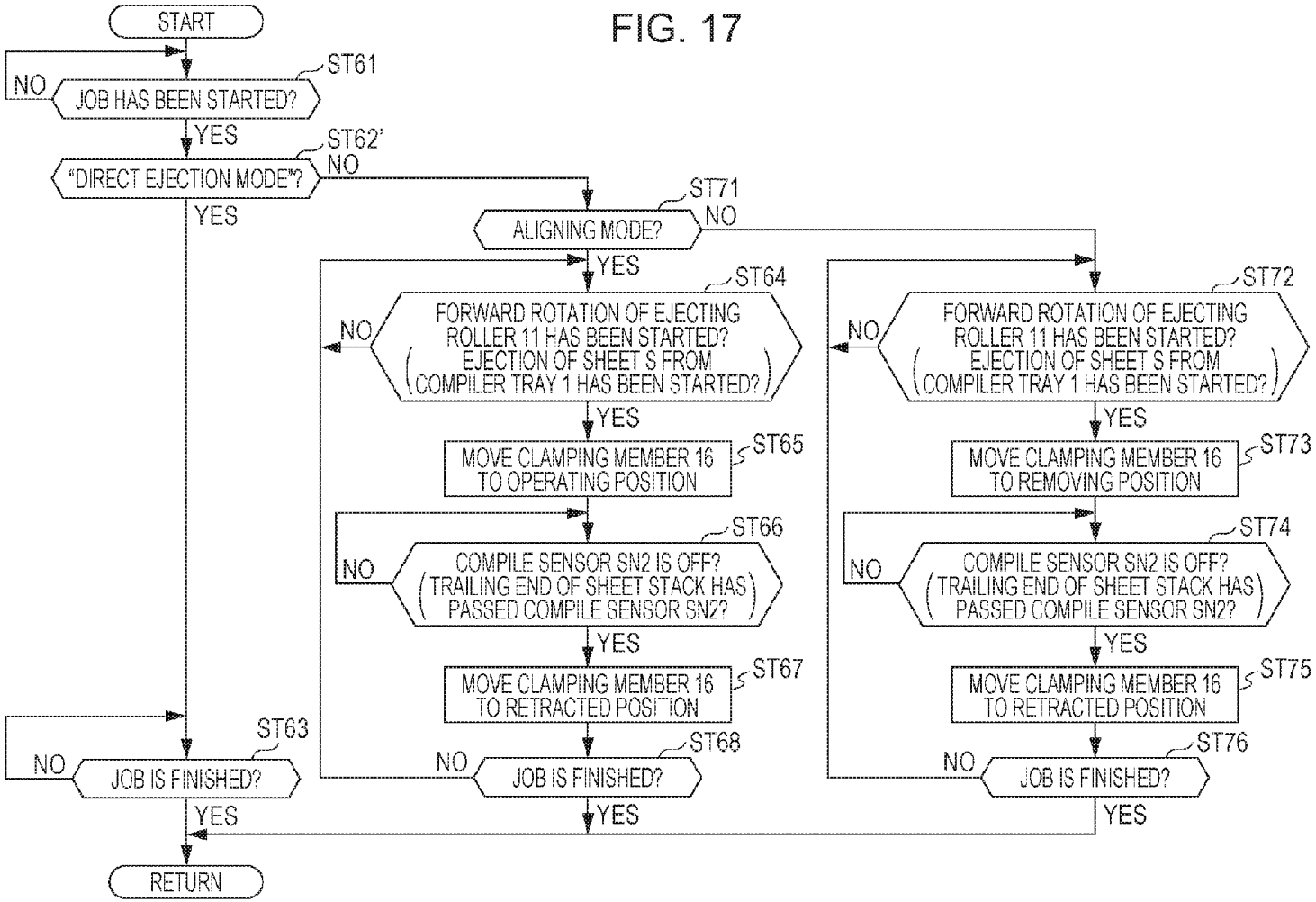
FIG. 17 is a flowchart of a clamping-member controlling process according to the second exemplary embodiment, and corresponds to FIG. 10 illustrating the first exemplary embodiment.

FIG. 17 is a flowchart of a clamping-member controlling process according to the second exemplary embodiment, and corresponds to FIG. 10 illustrating the first exemplary embodiment.

Referring to FIG. 17, in the clamping-member controlling process according to the second exemplary embodiment, ST62' is executed instead of ST62 in the clamping-member controlling process of the first exemplary embodiment. In the clamping-member controlling process of the second exemplary embodiment, ST71, which is executed when the result of the determination in ST62' is No (N), is additionally provided between ST62' and ST64. Moreover, in the clamping-member controlling process of the second embodiment, ST72 to ST76, which are executed when the result of the determination in ST71 is No (N), are additionally provided. The clamping-member controlling process of the second exemplary embodiment is similar to that of the first exemplary embodiment except for ST62', ST71, and ST72 to ST76. Therefore, only ST62', ST71, and ST72 to ST76 will be described.

Referring to FIG. 17, in ST62', it is determined whether or not the "direct ejection mode" is set. When the result of the determination is Yes (Y), the process proceeds to ST63. When the result of the determination is No (N), the process proceeds to ST71.

In ST71, it is determined whether or not the "aligning mode" is set. When the result of the determination is Yes (Y), the process proceeds to ST64. When the result of the determination is No (N), the process proceeds to ST72.

In ST72, it is determined whether or not the ejection of the sheets S from the compiler tray 1 has been started, that is, whether or not forward rotation of the ejecting roller 11 has been started. When the result of the determination is Yes (Y), the process proceeds to ST73. When the result of the determination is No (N), ST72 is repeated.

In ST73, the clamping member 16 is moved to the removing position. Then, the process proceeds to ST74.

In ST74, it is determined whether or not the trailing end of the sheet stack has passed the compile sensor SN2, that is, whether or not the compile sensor SN2 is OFF. When the result of the determination is Yes (Y), the process proceeds to ST75. When the result of the determination is No (N), ST74 is repeated.

In ST75, the clamping member 16 is moved to the retracted position. Then, the process proceeds to ST76.

In ST76, it is determined whether or not the job is finished. When the result of the determination is Yes (Y), the process returns to ST61. When the result of the determination is No (N), the process returns to ST72.

Operation of Second Exemplary Embodiment

In the finisher U4' according to the second exemplary embodiment having the above-described structure, the stacker tray TH1 and the clamping member 16 are controlled similarly to the first exemplary embodiment in the "direct ejection mode" and the "aligning mode". Accordingly, also in the second exemplary embodiment, when a sheet stack is ejected in the "aligning mode", the clamping member 16 presses the sheet stacks on the stacker tray TH1 and prevents the sheets S from being disarranged.

In the "stapling mode" according to the second exemplary embodiment, unlike the first exemplary embodiment, the upward and downward movement of the stacker tray TH1 is controlled on the basis of the upper sensor SNa. In addition, when a sheet stack is ejected, the clamping member 16 is moved to the removing position instead of the operating position. Accordingly, when the sheet stack is ejected, the clamping member 16 is easily disposed so as to be separated from the sheets S on the stacking surface TH1*a* of the stacker tray TH1. Therefore, similar to the first exemplary embodiment, also in the second exemplary embodiment, the sheets S ejected to the stacker tray TH1 are not easily disarranged and the noise is reduced.

In the first exemplary embodiment, the relative distance between the clamping member 16 and the stacker tray TH1 is changed between the "stapling mode" and the "aligning mode" by changing the way in which the upward and downward movement of the stacker tray TH1 is controlled. In the second exemplary embodiment, the upward and downward movement of the stacker tray TH1 is controlled in the same way, and the distance is changed by changing the way in which the rotation of the clamping member 16 is controlled. Accordingly, sufficient stacking performance of the sheet stacks ejected to the stacker tray TH1 is ensured and the noise is reduced.

Also in the "stapling mode" of the second exemplary embodiment, when there is a sheet stack that leans against the cover, the clamping member 16 moved to the removing position easily comes into contact with the trailing end of the leaning sheet stack in the ejecting direction, and the position of the leaning sheet stack is easily corrected.

Modifications

Although exemplary embodiments of the present invention have been described in detail, the present invention is not limited to the exemplary embodiments, and various modifications are possible within the scope of the present invention described in the claims. Exemplary modifications (H01) to (H09) of the present invention will be described.

(H01) In the exemplary embodiment, the printer U is described as an example of an image forming apparatus. However, the image forming apparatus is not limited to this, and may instead be another type of machine including a post-processing device, such as a copying machine, a facsimile machine, or a multifunction machine having the functions of these machines.

(H02) In the above-described exemplary embodiments, the relative distance between the clamping member 16 and the stacker tray TH1 is changed between the "stapling mode" and the "aligning mode" by changing the way in which the upward and downward movement of the stacker tray TH1 is controlled in the first exemplary embodiment and by changing the way in which the rotation of the clamping member 16 is controlled in the second exemplary embodiment. However, the present invention is not limited to this. For example, the relative distance between the clamping member 16 and the stacker tray TH1 may be changed between the "stapling mode" and the "aligning mode" by controlling both the stacker tray TH1 and the clamping member 16 in each mode.

(H03) In each exemplary embodiment, the clamping member 16 is supported by the rotating shaft 14, and the position thereof is controlled by applying a driving force of the stepper motor 17 to the clamping member 16. However, the present invention is not limited to this. For example, a transmission system may be provided between the ejection shaft 9 of the ejecting roller 11 and the rotating shaft 14, and the position of the clamping member 16 may be controlled by transmitting a driving force of the forward and reverse rotation of the ejection shaft 9 through a driving-force-transmission switching member, such as an electromagnetic clutch, for a preset time.

(H04) In each exemplary embodiment, the clamping member 16, which is an example of a pressing member, is reciprocated by driving the stepper motor 17 in the forward and reverse directions. However, the movement of the pressing member is not limited to the reciprocating movement. For example, the pressing member may be configured so as to be rotatable in one direction and rotated from the pressing position or the close position to the retracted position by receiving a one-way driving force of a driving source. More specifically, a structure in which a set clamp paddle, such as those described in, for example, Japanese Unexamined Patent Application Publication Nos. 2006-69746 and 2006-69749, is moved may be applied.

(H05) In each exemplary embodiment, the clamping member 16 is moved by a rotational driving force applied by the stepper motor 17. However, the driving source of the clamping member 16 is not limited to the motor. For example, the clamping member may be moved by a solenoid, which is an example of a driving source, and a spring, which is an example of an urging member. In this case, for example, a stopper that regulates the movement of the clamping member may be provided, and the position to which the clamping member is moved may be changed between the pressing position and the close position depending on the mode by changing the position of the stopper depending on the mode.

(H06) In each exemplary embodiment, in both the "stapling mode" and the "aligning mode", the clamping member 16 is moved from the retracted position when the ejection of the sheet stack is started, and returned to the retracted position after the sheet stack has passed the compile sensor SN2. However, the present invention is not limited to this, and the clamping member 16 may be moved at a different timing. For example, in the "stapling mode", the clamping member 16 may be moved from the retracted position when the sheet stack is ejected to the stacker tray TH1.

(H07) In each exemplary embodiment, the clamping member 16 is not driven in the "direct ejection mode". However, the present invention is not limited to this. For example, the clamping member 16 may be driven similarly to the "aligning mode".

(H08) In each exemplary embodiment, the "direct ejection mode" may be set. In the "direct ejection mode", the sheets S fed to the compiler tray 1 are directly ejected to the stacker tray TH1 without being stacked together. However, the "direct ejection mode" may be omitted. In other words, the structure may be such that only the sheets S to be stacked together are fed to the compiler tray 1, and the sheets S that are not to be stacked together are ejected to the top tray TH0.

(H09) In each exemplary embodiment, when a sheet stack is ejected, the tampers 2 and 3 may be activated to perform offset ejection in which the sheet stack is shifted in the width direction. However, the present invention is not limited to this. The sheet stack may be ejected without activating the tampers 2 and 3 and shifting the sheet stack in the width direction.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a processing stacking portion configured to allow a plurality of media transported from an upstream side to be stacked on the processing stacking portion;

a binding member configured to perform a binding process on the media stacked on the processing stacking portion;

a medium ejection portion on which the media ejected from the processing stacking portion are stacked, wherein the medium ejection portion is configured to move upward and downward in accordance with an amount of the media stacked on the medium ejection portion; and a pressing member configured to press an upper surface of the media stacked on the medium ejection portion, wherein, when media that have not been subjected to the binding process are stacked on the medium ejection portion, the pressing member and the media on the medium ejection portion are brought into contact with each other, and when media that have been subjected to the binding process are stacked on the medium ejection portion, the pressing member is moved to a position towards but without contacting the media that have been subjected to the binding process.

2. The post-processing device according to claim 1, further comprising:

a medium-ejection-portion control unit configured to:

move the medium ejection portion to a preset first position, at which the media on the medium ejection portion are in contact with the pressing member, when media that have not been subjected to the binding process are stacked on the medium ejection portion, and move the medium ejection portion to a preset second position, which is below the first position and at which the media on the medium ejection portion are separated from the pressing member, when media that have been subjected to the binding process are stacked on the medium ejection portion.

3. The post-processing device according to claim 1, wherein the pressing member is movable to a pressing position at which the pressing member is in contact with the upper surface of the media on the medium ejection portion and presses the media, a retracted position at which the pressing member is retracted from a region through which the media ejected from the processing stacking portion pass before being stacked on the medium ejection portion, and a close position at which the pressing member is separated from but close to the media stacked on the medium ejection portion, and wherein the post-processing device further comprises:

a pressing-member control unit configured to:

move the pressing member from the retracted position to the pressing position when media that have not been subjected to the binding process are stacked on the medium ejection portion, and move the pressing member from the retracted position to the close position when media that have been subjected to the binding process are stacked on the medium ejection portion.

4. The post-processing device according to claim 2, wherein the pressing member is movable to a pressing position, at which the pressing member is in contact with the upper surface of the media on the medium ejection portion and presses the media, a retracted position at which the pressing member is retracted from a region through which the media ejected from the processing stacking portion pass before being stacked on the medium ejection portion, and a close position at which the pressing member is separated from but close to the media stacked on the medium ejection portion, and wherein the post-processing device further comprises:

a pressing-member control unit configured to:

move the pressing member from the retracted position to the pressing position when media that have not been subjected to the binding process are stacked on the medium ejection portion, and move the pressing member from the retracted position to the close position when media that have been subjected to the binding process are stacked on the medium ejection portion.

5. An image forming apparatus comprising:

an image forming apparatus body configured to record images on media; and the post-processing device according to claim 1 that is connected to the image forming apparatus body and receives the media on which the images are recorded.

6. The post-processing device according to claim 1, wherein when media that have been subjected to the binding process are stacked on the medium ejection portion and a trailing end of the media leans away from the medium ejection portion, the pressing member and the media subjected to the binding process are brought into contact with each other.

7. The post-processing device according to claim 1, further comprising:

a medium ejection control unit that is configured to, in response to the media not being subjected to the binding process, move the medium ejection portion to a first position, wherein the pressing member is brought into contact with the media subjected to the binding process stacked on medium ejection portion, and in response to the media being subjected to the binding process, move the medium ejection portion to a second position, the second position being lower than the first position, wherein the pressing member is disposed to the area near but without contacting the media subjected to the binding process.

8. The post-processing device according to claim 7, wherein the medium ejection control unit is further configured to move the medium ejection portion so that an upper surface of the media, not being subjected to the binding process and having been previously ejected, is at the first position.

9. The post-processing device according to claim 7, wherein the medium ejection control unit is further configured to move the medium ejection portion so that an upper surface of the media, being subjected to the binding process and having been previously ejected, is at the second position.

10. The post-processing device according to claim 1, wherein the pressing member is moved to the position towards but without contacting the media that have been subjected to the binding process further comprises the pressing member being disposed to a same position as when the media that have not been subjected to the binding process are stacked on the medium ejection portion but without contacting the media that have been subjected to the binding process.

* * * * *